US007671004B2

(12) United States Patent
Holland et al.

(10) Patent No.: US 7,671,004 B2
(45) Date of Patent: Mar. 2, 2010

(54) CLEANING COMPOSITION AND METHOD OF FORMING THE SAME

(75) Inventors: Richard J. Holland, Flanders, NJ (US); Jesse Jefferis, Wayne, MI (US); Kathleen M. Guiney, Wyandotte, MI (US); Brian J. Betke, Riverview, MI (US)

(73) Assignee: BASF Aktiengeselschaft, Ludwigshafen (DE)

( * ) Notice: Subject to any disclaimer, the term of this patent is extended or adjusted under 35 U.S.C. 154(b) by 0 days.

(21) Appl. No.: 12/023,467

(22) Filed: Jan. 31, 2008

(65) Prior Publication Data

US 2008/0188396 A1 Aug. 7, 2008

Related U.S. Application Data

(60) Provisional application No. 60/887,717, filed on Feb. 1, 2007.

(51) Int. Cl.
*C11D 1/72* (2006.01)
*C11D 1/12* (2006.01)
*C11D 1/83* (2006.01)

(52) U.S. Cl. ..... 510/360; 510/342; 510/365; 510/421; 510/475; 510/505; 510/524; 510/525

(58) Field of Classification Search ..... 510/342, 510/360, 365, 421, 475, 505, 524, 525
See application file for complete search history.

(56) References Cited

U.S. PATENT DOCUMENTS

| | | | | |
|---|---|---|---|---|
| 5,331,039 | A | 7/1994 | Blum et al. | |
| 6,133,218 | A * | 10/2000 | Kerobo et al. | 510/365 |
| 2005/0170991 | A1 * | 8/2005 | Ruland et al. | 510/421 |
| 2005/0181967 | A1 | 8/2005 | Ruland et al. | |

FOREIGN PATENT DOCUMENTS

JP 2004-035755 2/2004

OTHER PUBLICATIONS

English language translation and abstract for JP2004-035755 extracted from Searching PAJ, Jan. 29, 2008, 31 pages.

* cited by examiner

*Primary Examiner*—Brian P Mruk
(74) *Attorney, Agent, or Firm*—Howard & Howard Attorneys PLLC

(57) ABSTRACT

A cleaning composition comprises a first surfactant and a second surfactant. The first surfactant is of the general formula $R^1$—O-$(A)_m$H, wherein $R^1$ is an aliphatic hydrocarbon having from 10 to 16 carbon atoms, A is an alkyleneoxy group, and subscript m is a positive number. The second surfactant is of the general formula $R^2$—O—$(B)_n$H, wherein $R^2$ is an aliphatic hydrocarbon having from 12 to 15 carbon atoms, B is an alkyleneoxy group, and subscript n is a positive number. The cleaning composition has an average degree of alkoxylation of from about 3 to about 8 moles and an excess of the first surfactant relative to said second surfactant. The cleaning composition can further comprise a third surfactant in addition to the first and second surfactants. If employed, the third surfactant typically can comprise a linear alkyl sulfonate (LAS) and/or an alkyl ether sulfate (AES).

38 Claims, 6 Drawing Sheets

CLEANING COMPOSITION AND METHOD OF FORMING THE SAME

CROSS REFERENCE TO RELATED APPLICATIONS

This application claims the benefit of U.S. Provisional Patent Application Ser. No. 60/887,717, filed on Feb. 1, 2007, which is incorporated herewith in its entirety.

FIELD OF THE INVENTION

The present invention generally relates to a cleaning composition and, more specifically, to a cleaning composition comprising alkoxylated alcohols, a method of preparing the cleaning composition, and a detergent composition including the cleaning composition.

DESCRIPTION OF THE RELATED ART

Cleaning compositions are well known in the art and are often used in households as cleaners such as in laundry detergents and dishwashing liquids. To remain competitive in the marketplace, e.g. by reducing raw material costs, many manufacturers of cleaning compositions have reduced the amounts of active ingredients such as surfactants in the cleaning compositions. However, by reducing the amount of the active ingredients, the viscosities of the cleaning compositions decrease. Unfortunately, consumers of the cleaning compositions have associated low viscosity cleaning compositions, e.g. "water thin", with inferior cleaning properties such as cleaning power when compared to higher viscosity cleaning compositions, e.g. "vegetable oil thick".

To increase the viscosities of the cleaning compositions having reduced amounts of the active ingredients, a thickening agent such as an associative thickener is typically added to the cleaning compositions. However, the thickening agent adds to the raw material cost of the cleaning compositions and further adds an additional step in manufacturing. In addition, the thickening agent does not aid in cleaning properties of the cleaning compositions with regard to cleaning power. In other words, the thickening agent is only useful for increasing viscosity of the cleaning compositions.

Many cleaning compositions in the art utilize an alkoxylated nonylphenol, specifically, nonylphenol ethoxylate (NPE), as a primary active ingredient, which gives desired viscosity and cleaning properties of the cleaning compositions. However, NPE is currently recognized as a hazardous material by the United States Environmental Protection Agency (EPA). Accordingly, many manufacturers under pressure to go "Green" are phasing out the use of NPE in cleaning compositions and are seeking suitable replacements for NPE.

There remains an opportunity to provide cleaning compositions that have reduced amounts of active ingredients for cost saving while still maintaining desirable viscosities and cleaning properties. In addition, there also remains an opportunity to provide cleaning compositions that are free or substantially free of thickening agents and/or NPE.

SUMMARY OF THE INVENTION AND ADVANTAGES

A cleaning composition comprises a first surfactant of the general formula $R^1$—O-$(A)_m$H wherein $R^1$ is an aliphatic hydrocarbon having on average from 10 to 16 carbon atoms, A is an alkyleneoxy group, and subscript m is a positive number. The cleaning composition further comprises a second surfactant of the general formula $R^2$—O—$(B)_n$H wherein $R^2$ is an aliphatic hydrocarbon having on average from 12 to 15 carbon atoms, B is an alkyleneoxy group, and subscript n is a positive number. The cleaning composition has an average degree of alkoxylation of from about 3 to about 8 moles. The cleaning composition also has an excess of the first surfactant relative to the second surfactant.

The present invention provides a unique combination of the first and second surfactants. Generally, the first surfactant imparts the cleaning composition with excellent detergency characteristics, and the second surfactant imparts the cleaning composition with desirable viscosity profiles. The cleaning composition of the present invention also has other desirable properties, such as increased solubility. The cleaning composition of the present invention may be used, for example, to replace nonylphenol ethoxylate (NPE) as an active agent in a detergent composition while maintaining desirable product viscosity.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
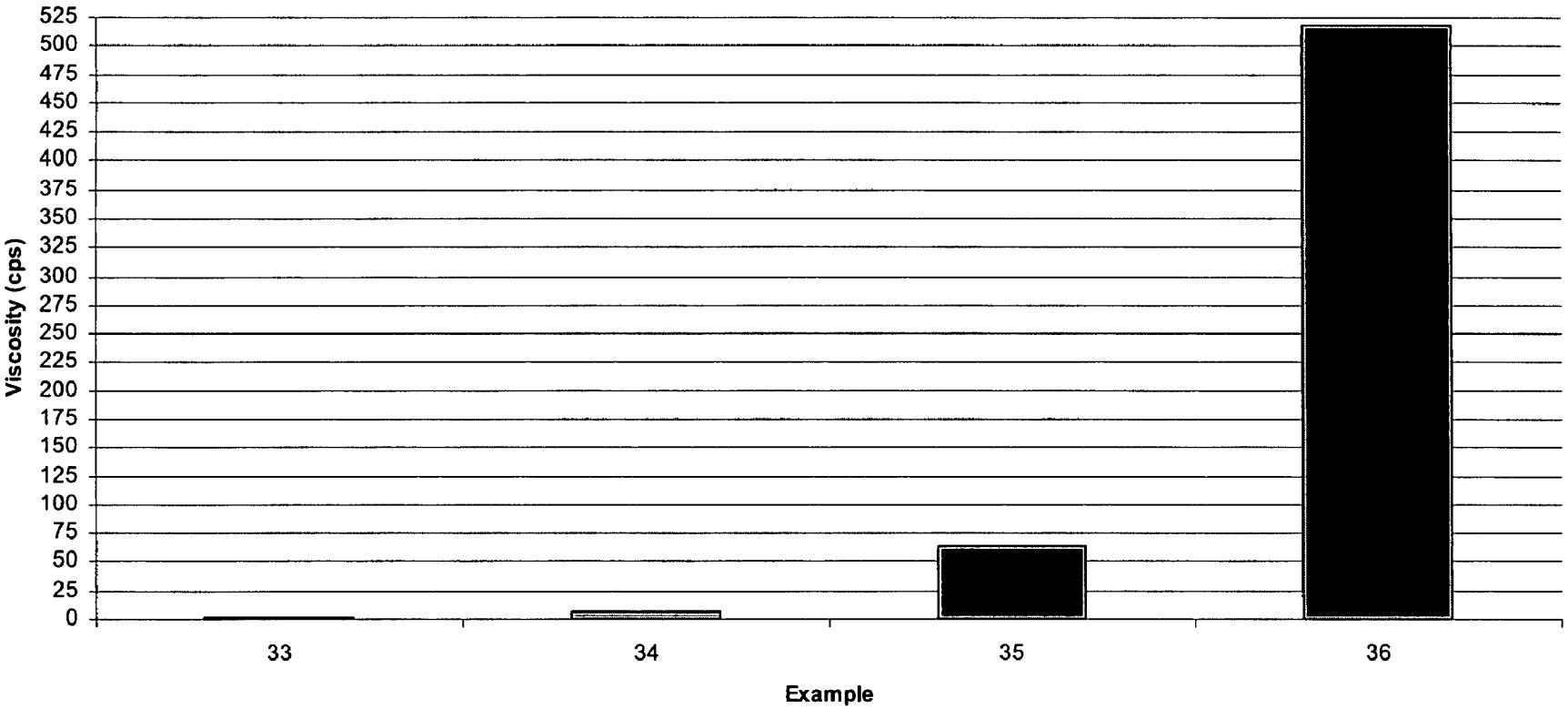
FIG. 1 is a bar chart illustrating viscosities of Examples 33-36.

The present invention provides a cleaning composition, which may be used in any industry and for any application. For example, the cleaning composition may be used in a laundry detergent for cleaning clothes or in a dishwashing liquid for cleaning silverware, pots, pans, and dishes. The cleaning composition, in one or more embodiments, may also be used for other purposes besides cleaning. For example, the cleaning composition can be used as a surfactant composition. Therefore, the present invention should not be thought of as limited to compositions that are only used to clean.

The cleaning composition comprises a first surfactant. Typically, the first surfactant is a nonionic surfactant. The first surfactant may have any respective cloud point, any respective hydrophilic-lipophilic balance (HLB), and any respective critical micelle content (CMC). Cloud point is described in further detail below. The first surfactant is of the general formula $R^1$—O-$(A)_m$H. In this formula, $R^1$ is an aliphatic hydrocarbon typically having on average from 10 to 16 carbon atoms. As is understood in the art, aliphatic hydrocarbons may include straight, branched, and/or cyclic chains of carbon and hydrogen atoms which may be saturated or unsaturated. It is contemplated that $R^1$ may include a mixture of different aliphatic hydrocarbons having a normal distribution from 10 to 16 carbon atoms. Alternatively, $R^1$ may be an aliphatic hydrocarbon having 10 carbon atoms, 12 carbon atoms, 14 carbon atoms, or 16 carbon atoms. In one embodiment, $R^1$ is an aliphatic hydrocarbon having on average from 12 to 14 carbon atoms. In another embodiment, $R^1$ is an aliphatic hydrocarbon having on average about 12 carbon atoms.

It is contemplated that $R^1$ may have an average degree of branching of zero or may have an average degree of branching of greater than zero. Typically, $R^1$ has an average degree of branching of approaching or equal to zero (0), more typically an average degree of branching equal to about zero. In these embodiments, $R^1$ of the first surfactant is linear, and therefore, the first surfactant is generally classified as linear. It is believed that when $R^1$ of the first surfactant is linear, rather than being branched, lower CMC is obtained, in addition to the cleaning composition being more stable.

The degree of branching is defined as a number equal to the number of carbon atoms in the aliphatic hydrocarbon (3° carbon atoms) which are bonded to three additional carbon atoms, plus two times the number of carbon atoms in the aliphatic hydrocarbon (4° carbon atoms) which are bonded to four additional carbon atoms. The average degree of branching is calculated as a sum of all degrees of branching of individual aliphatic hydrocarbon molecules divided by a total number of the individual aliphatic hydrocarbon molecules. The degree of branching may be determined, for example, through use of $^{13}C$ NMR methods such as correlation spectroscopy (COSY), followed by quantification via use of relaxation reagents. Other NMR methods and GC-MS methods known to those skilled in the art may also be used to determine the degree of branching.

In the formula above, A is an alkyleneoxy group. The alkyleneoxy group may include, but is not limited to, ethyleneoxy (EO) groups having two (2) carbon atoms, propyleneoxy (PO) groups having three (3) carbon atoms, butyleneoxy (BO) groups having four (4) carbon atoms, pentyleneoxy groups having five (5) carbon atoms, and combinations thereof. The BO groups may include any or all of 1,2-butylene oxide groups, 2,3-butylene oxide groups, and isobutylene oxide groups. In one embodiment, A is an EO group. It is to be appreciated that the cleaning composition may include a combination of two or more of the alkyleneoxy groups as described and exemplified above, such as EO and PO groups, EO and BO groups, EO, PO, and BO groups, etc. For purposes of the present invention, it is to be appreciated that the alkyleneoxy groups are typically open, rather than being strained rings. In other words, the alkyleneoxy groups described herein are generally formed from an alkylene oxide, e.g. ethylene oxide. For example, with reference to Reaction Schemes (I) and (III) below, A is formed from ethylene oxide reacting with the first aliphatic alcohol after the first aliphatic alcohol is alkoxylated.

Further, subscript m is a positive number. As understood in the art, subscript m represents the average number of moles of the alkyleneoxy group added to the aliphatic hydrocarbon of the first surfactant. It is contemplated that subscript m can be any whole number or any fraction of a number greater than zero. In one embodiment, the first surfactant includes a mixture of molecules having a differing number of moles of the alkyleneoxy group added to the aliphatic hydrocarbon molecules. Typically, subscript m is a number of from about 1 to about 8, more typically from about 3 to about 8, and most typically from about 5 to about 7. In one embodiment, subscript m is equal to about 6. When subscript m is greater than or equal to 2, it is contemplated that the alkyleneoxy groups may be distributed randomly or blockwise. It is believed that when subscript m is a low number, e.g. less than about 8, the viscosity of the cleaning composition is increased relative to when subscript m is a higher number, e.g. greater than about 8. In other words, the viscosity of the cleaning composition generally increases as the value of subscript m decreases.

The cleaning composition further comprises the second surfactant. Typically, the second surfactant is a nonionic surfactant. Generally, the cleaning composition itself is classified as a nonionic surfactant, due to the first and second surfactants it is formed from. The second surfactant may have any respective cloud point, any respective HLB, and any respective CMC. If a nonionic surfactant is employed as at least one of the surfactants, the nonionic surfactant typically has a cloud point (both aqueous and solvent) of from about 25 to about 90, more typically from about 30 to about 80, and most typically from about 30 to about 70, °C. The cloud point of the nonionic surfactant may be determined by any method known in the art. For example, to determine an aqueous cloud point of the nonionic surfactant, 1% by weight of the nonionic surfactant is added to water to form a solution. The solution is either heated or cooled until a visual change is noted such the solution changing from clear to cloudy or vice versa.

The second surfactant is of the general formula $R^2$—O—$(B)_nH$. In this formula, $R^2$ is typically an aliphatic hydrocarbon having from 12 to 15 carbon atoms. It is contemplated that $R^2$ may include a mixture of different aliphatic hydrocarbons having a normal distribution from 12 to 15 carbon atoms. Alternatively, $R^2$ may be an aliphatic hydrocarbon having 12 carbon atoms, 13 carbon atoms, 14 carbon atoms, or 15 carbon atoms. In one embodiment, $R^2$ is an aliphatic hydrocarbon having on average from 13 to 15 carbon atoms.

It is contemplated that $R^2$ may have an average degree of branching of zero or may have an average degree of branching of greater than zero. Typically, $R^2$ has an average degree of branching of from about 3 to about 5. In this embodiment, $R^2$ of the second surfactant is branched, and therefore, the second surfactant is generally classified as branched. It is believed that branching helps to increase viscosity of the cleaning composition. In addition, branching is believed to aid in the stability of forming emulsions, which is a primary benefit in detergency of the cleaning composition. It is also believed that too much branching can lead to clouding of the cleaning composition, as understood to those skilled in the art. For purposes of the present invention, it is to be appreciated that the $R^1$—O and $R^2$—O groups of the surfactants, as illustrated and described above, may also be known in the art as alkoxide groups.

In the formula above, B is an alkyleneoxy group, and may be the same as or different than A, as described and exemplified above with description of the first surfactant. In one embodiment, B is an EO group. It is to be appreciated that the alkyleneoxy groups are typically open, rather than being strained rings. For example, with reference to Reaction Schemes (II) and (III) below, B is formed from an alkylene oxide, e.g. ethylene oxide, reacting with the second aliphatic alcohol after the second aliphatic alcohol is alkoxylated. Subscript n is a positive number, may be any fraction or whole number greater than zero, and may be the same as or different than subscript m. As understood in the art, subscript n represents the average number of moles of the alkyleneoxy group added to the aliphatic hydrocarbon of the second surfactant. Typically, subscript n is a number of from about 1 to about 8, more typically from about 3 to about 8, and most typically from about 6 to about 8. In one embodiment, subscript n is equal to about 7. When n is greater than or equal to 2, it is contemplated that the alkyleneoxy groups may be distributed randomly or blockwise. The viscosity of the cleaning composition generally increases as the value of subscript n decreases.

The cleaning composition has an average degree of alkoxylation of from about 3 to about 8 moles, more typically from about 5 to about 7 moles, yet more typically from about 6 to about 7 moles, and most typically about 6 moles. As described above, subscripts m and n represent the average number of moles of the alkyleneoxy groups added to the aliphatic hydrocarbon of the respective first and second surfactants. Generally, when the average degree of alkoxylation is lower, e.g. 2 or less, the cleaning composition becomes unstable. On the other hand, when the average degree of alkoxylation is higher, e.g. 9 or more, viscosity of the cleaning composition drops, i.e., is too low.

Suitable surfactants, for purposes of the present invention, are commercially available from BASF Corporation of Florham Park, N.J., under the trade name Lutensol®, such as Lutensol® XP 90, Lutensol® XL 90, Lutensol® XL 50, Lutensol® XP 70, Lutensol® XP 50, Lutensol® XP 30, Lutensol® A 65 N, Lutensol® A 9 N, Lutensol® LA 60, Lutensol® TDA 6, Lutensol® TDA 9, Lutensol® TO 5, Lutensol® AO 7, Lutensol® AO 8, and Lutensol® AO 8 A. Further suitable surfactants, for purposes of the present invention, are commercially available from Shell Chemicals of Houston, Tex., under the trade name Neodol®, such as Neodol® 45-77 and Neodol® 25-7. Yet further suitable surfactants, for purposes of the present invention, are commercially available from Air Products and Chemicals, Inc. of Allentown, Pa. under the trade name of Tomadol®, such as Tomadol® 45-7. It is to be appreciated that various combinations of the aforementioned surfactants can be employed.

The cleaning composition has an excess of the first surfactant relative to the second surfactant, i.e., the first surfactant is present in the cleaning composition in a greater amount than the second surfactant. In certain embodiments, the first surfactant is present in the cleaning composition in a weight ratio of from about 3:1 to about 5:1, more typically in a weight ratio of about 4:1, relative to the second surfactant. Typically, the first surfactant is present in the cleaning composition in an amount of from about 40 to about 90, more typically from about 50 to about 80, and most typically about 60 to about 80, parts by weight, based on 100 parts by weight of the cleaning composition. In one embodiment, the first surfactant is present in an amount of about 80 parts by weight based on 100 parts by weight of the cleaning composition. Typically, the second surfactant is present in the cleaning composition in an amount of from about 10 to about 60, more typically from about 10 to about 50, and most typically about 20 to about 40, parts by weight, based on 100 parts by weight of the cleaning composition. In one embodiment, the second surfactant is present in an amount of about 20 parts by weight based on 100 parts by weight of the cleaning composition. In one embodiment, the cleaning composition consists essentially of the first and second surfactants. In another embodiment, the cleaning composition consists of the first and second surfactants. In these two embodiments, it is to be appreciated that the first and second surfactants are as described and exemplified above.

Without being bound or limited by any particular theory, it is believed that the ratio of first and second surfactants, as described and exemplified above, provides benefits of two+ alkoxylate chains, e.g. EO groups, and linear vs. branched carbon chains, e.g. $R^1$ and $R^2$, of the respective surfactants. Specifically, it is also believed that the second surfactant enhances viscosity and emulsification stability of the cleaning composition, but is present in the cleaning composition at levels so as not to be unstable in the cleaning composition or other compositions employing the cleaning composition, e.g. a detergent composition. It is also believed that the first surfactant provides stability and primary detergency of the cleaning composition, but is present in the cleaning composition at levels so as not to lower viscosity of the cleaning composition or other compositions employing the cleaning composition, e.g. a detergent composition.

In certain embodiments, the cleaning composition further comprises a third surfactant different from the first surfactant and the second surfactant. The third surfactant may be an ionic surfactant, a nonionic surfactant, or an amphoteric surfactant. In certain embodiments, the third surfactant is an anionic surfactant. In one embodiment, the third surfactant is a linear alkyl sulfonate (LAS), such as a linear alkylbenzene sulfonate (LABS). In another embodiment, the third surfactant is an alkyl ether sulfate (AES). Generally, employing LAS in place of AES provides higher viscosity profiles for the cleaning composition. Examples of other suitable third surfactants, for purposes of the present invention, include, but are not limited to, aliphatic and/or aromatic alkoxylated alcohols, paraffinsulfonates, fatty alcohol sulfates (FAS), fatty alcohol ethersulfates (FAES), trimethylolpropane ethoxylates, glycerol ethoxylates, pentaerythritol ethoxylates, alkoxylates of bisphenol A, and alkoxylates of 4-methylhexanol and 5-methyl-2-propylheptanol, and combinations thereof. It is to be appreciated that the third surfactant of the cleaning composition may include a combination of two or more of the aforementioned surfactants.

If employed, the third surfactant, e.g. LAS, is typically present in the cleaning composition in a weight ratio of from about 2:1 to about 1:5, more typically in a weight ratio of from about 1:1 to about 1:3, and most typically about 1:3, relative to the first surfactant and the second surfactant combined. In one embodiment, the third surfactant is present in the cleaning composition in a weight ratio of about 1:2. In another embodiment, the third surfactant is present in the cleaning composition in a weight ratio of about 1:1. Typically, the third surfactant is present in the cleaning composition in an amount of from about 25 to about 75, more typically from about 25 to about 60, and most typically from about 25 to about 55, parts by weight, based on 100 parts by weight of the cleaning composition. In one embodiment, the third surfactant is present in an amount of about 50 parts by weight based on 100 parts by weight of the cleaning composition. In another embodiment, the third surfactant is present in an amount of about 33 parts by weight based on 100 parts by weight of the cleaning composition. In yet another embodiment, the third surfactant is present in an amount of about 25 parts by weight based on 100 parts by weight of the cleaning composition. In the aforementioned embodiments, the first surfactant is typically present in the cleaning composition in an amount of from about 20 to about 45, more typically from about 25 to about 40, and most typically about 30 to about 40, parts by weight, based on 100 parts by weight of the cleaning composition. Further, the second surfactant is present in the cleaning composition in an amount of from about 5 to about 30, more typically from about 5 to about 25, and most typically about 10 to about 20, parts by weight, based on 100 parts by weight of the cleaning composition. In one embodiment, the third surfactant is present in the cleaning composition in an amount of from about 25 to about 50 parts by weight, the first surfactant is present in the cleaning composition in an amount of from about 40 to about 60 parts by weight, and the second surfactant is present in the cleaning composition in an amount of from about 10 to about 15 parts by weight, all based on 100 parts by weight of the cleaning composition. In one embodiment, the cleaning composition consists essentially of the first, second, and third surfactants. In another embodiment, the cleaning composition consists of the first, second, and third surfactants. In these two embodiments, it is to be appreciated that the first, second, and third surfactants are as described and exemplified above.

In addition to the first, second, and optionally, third surfactants, the cleaning composition may also include a polyalkylene glycol. It is to be appreciated that the polyalkylene glycol is an optional component, i.e., the cleaning composition can exclude the polyalkylene glycol altogether. If employed, the polyalkylene glycol generally includes, but is not limited to, polyethylene glycol (PEG), polypropylene glycol (PPG), polybutylene glycol (PBG), and combinations thereof. Typically, the polyalkylene glycol is polyethylene glycol. In one embodiment, if employed to prepare the cleaning composition, the polyalkylene glycol is typically present in an amount of from about 5 to about 50, more typically from about 5 to about 25, and most typically from about 5 to about 15, parts by weight, based on 100 parts by weight of the cleaning composition. In another embodiment, the cleaning composition is substantially free of the polyalkylene glycol. By "substantially free", it is meant that the cleaning composition typically includes the polyalkylene glycol in an amount of from about 15 to approaching zero (0), more typically from about 10 to approaching 0, and most typically from about 5 to approaching 0, parts by weight, based on 100 parts by weight of the cleaning composition. In yet another embodiment, the cleaning composition excludes the polyalkylene glycol altogether, as alluded to above.

The present invention further provides a method of forming the cleaning composition. The method of preparing the cleaning composition generally includes the step of alkoxylating a first aliphatic alcohol having on average from 10 to 16 carbon atoms in the presence of a catalyst to form the first surfactant. In certain embodiments, the polyalkylene glycol is also formed in addition to the first surfactant. The step of alkoxylating the first aliphatic alcohol includes reacting the catalyst with the first aliphatic alcohol to form an alkoxide. This step may be completed in the presence or absence of water. After the alkoxide is formed, the alkoxide is reacted with an alkylene oxide, e.g. ethylene oxide, to form the first surfactant, and sometimes, to form the polyalkylene glycol in situ. In one embodiment, the first aliphatic alcohol is alkoxylated with ethylene oxide, as described and exemplified above; however, it is to be appreciated that other alkylene oxides or blends thereof may be used. The first aliphatic alcohol may include any aliphatic alcohol having from 10 to 16 carbon atoms. In one embodiment the first aliphatic alcohol includes a mixture of different aliphatic alcohols having a normal distribution from 10 to 16 carbon atoms. Alternatively, the first aliphatic alcohol may have 10 carbon atoms, 12 carbon atoms, 14 carbon atoms, or 16 carbon atoms. Typically, the first aliphatic alcohol has from 12 to 14 carbon atoms. In one embodiment, the first aliphatic alcohol is linear. For descriptive purposes only, a chemical reaction scheme of the alkoxylation of the first aliphatic alcohol to form the first surfactant is generically shown in Reaction Scheme (I) below:

Reaction Scheme (I):

$$R^1\text{—}OH \xrightarrow{M\text{-}OH} R^1O^-M^+ + H_2O \xrightarrow{A_m} R^1\text{—}O\text{—}(A)_mH$$

Typically, the catalyst is a metal catalyst and includes an alkali metal or alkaline earth metal hydroxide, but may include any metal catalyst known in the art including transition metal organometallic catalysts. Particularly suitable alkali metal catalysts include, but are not limited to, sodium hydroxide, potassium hydroxide, and combinations thereof. The catalyst may be a single metal catalyst or may include a mixture of metal catalysts, as determined by one of skill in the art.

In addition to the step of alkoxylating the first aliphatic alcohol, the method also generally includes the step of alkoxylating a second aliphatic alcohol having on average from 12 to 15 carbon atoms in the presence of the catalyst to form the second surfactant and the polyalkylene glycol. The step of alkoxylating the second aliphatic alcohol includes reacting the catalyst with the second aliphatic alcohol to form an alkoxide. The catalyst may be the same as or different than the catalyst described and exemplified above. This step may also be completed in the presence or absence of water. After the alkoxide is formed, the alkoxide is reacted with an alkylene oxide, e.g. ethylene oxide, to form the second surfactant, and sometimes, to form the polyalkylene glycol in situ. In one embodiment, the second aliphatic alcohol is alkoxylkated with ethylene oxide, as described and exemplified above; however, it is to be appreciated that other alkylene oxides or blends thereof may be used. The second aliphatic alcohol may include any aliphatic alcohol having from 12 to 15 carbon atoms. In one embodiment the second aliphatic alcohol includes a mixture of different aliphatic alcohols having a normal distribution from 12 to 15 carbon atoms. Alternatively, the second aliphatic alcohol may have 12 carbon atoms, 13 carbon atoms, 14 carbon atoms, or 15 carbon atoms. Typically, the first aliphatic alcohol has 13 carbon atoms, 15 carbon atoms, or includes a mixture of different aliphatic alcohols having 13 and 15 carbon atoms. In one embodiment, the second aliphatic alcohol is branched. For descriptive purposes only, a chemical reaction scheme of the alkoxylation of the second aliphatic alcohol to form the second surfactant is generically shown in Reaction Scheme (II) below:

Reaction Scheme (II):

$$R^2\text{—}OH \xrightarrow{M\text{-}OH} R^2O^-M^+ + H_2O \xrightarrow{B_n} R^2\text{—}O\text{—}(B)_nH$$

It is contemplated that the step of alkoxylating the first aliphatic alcohol may be completed separately from, or simultaneously with, the step of alkoxylating the second aliphatic alcohol. Also, the first and second aliphatic alcohols may be alkoxylated in the same vessel or in different vessels. Typically, the first and second aliphatic alcohols are alkoxylated simultaneously in the same vessel. Generally, an excess of the first surfactant relative to the second surfactant is combined with the second surfactant to form the cleaning composition. In one embodiment, the first and second aliphatic alcohols are blended in a weight ratio of about 4:1, respectively, prior to the steps of alkoxylating. In other embodiments, the first and second aliphatic alcohols are blended at other weight ratios relative to each other prior to the steps of alkoxylating, as alluded to and exemplified above, such as in a weight ratio of from about 3:1 to about 5:1. It is to be appreciated that the first and second aliphatic alcohols may each be alkoxylated independently, and then blended at various weight ratios relative to each other. It is believed that properties of the cleaning composition, e.g. the viscosity, can be tailored depending on the ratio of the first and second aliphatic alcohol relative to each other and depending on when the steps of alkoxylating take place, i.e., before, during, or after the first and second aliphatic alcohols are blended. The steps of alkoxylating the first and second aliphatic alcohols may be completed at any temperature and at any pressure. Typically, these steps are completed at a temperature of from about 100 to about 150° C. and at a pressure of from about 30 to about 100 psig. For descriptive purposes only, a chemical reaction scheme including the alkoxylation, specifically ethoxylation of the first and second aliphatic alcohols in the presence of potassium hydroxide as the catalyst, to form the first and second surfactants, is shown in Reaction Scheme (III) below:

Reaction Scheme (III):

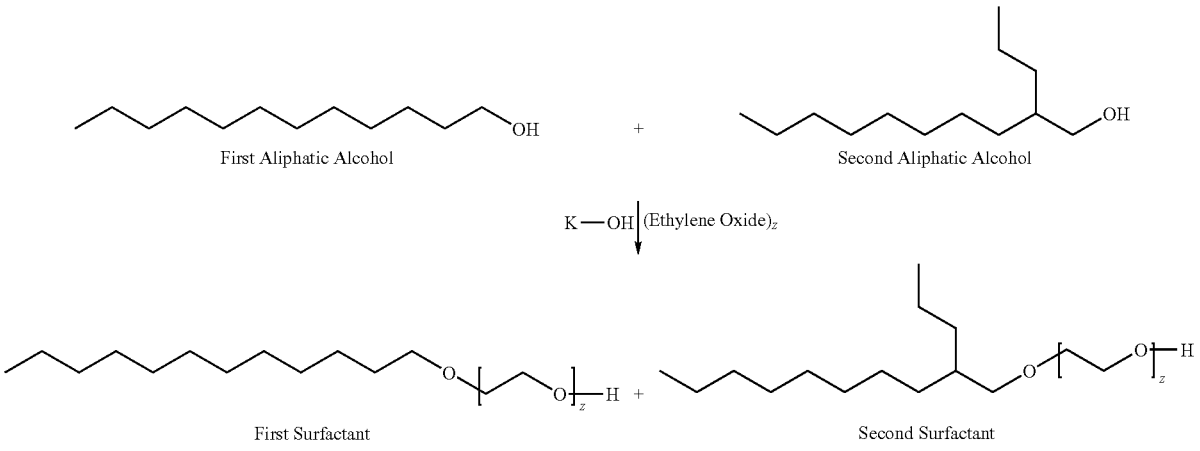

wherein z is a number from 3 to 8. In Reaction Scheme (III) above, the first and second surfactants are typically classified as alcohol ethoxylates.

The present invention yet further provides a detergent composition. The composition comprises a nonionic surfactant. Typically, the nonionic surfactant is the cleaning composition as described and exemplified above. In other words, the detergent composition includes the first and second surfactants, as described and exemplified above. The nonionic surfactant is typically present in an amount of from about 1 to about 9, more typically from about 1 to about 5, and most typically from about 3 to about 5, parts by weight, based on 100 parts by weight of the detergent composition. In one embodiment, the nonionic surfactant is present in the detergent composition in an amount of about 3 parts by weight based on 100 parts by weight of the detergent composition. In certain aforementioned embodiments, the first surfactant is present in the nonionic composition in a weight ratio of from about 3:1 to about 5:1, more typically in a weight ratio of about 4:1, relative to the second surfactant, as described and exemplified above. These embodiments are useful for lowering the cost of the detergent composition while still maintaining desired viscosity and cleaning properties of the detergent composition.

The detergent composition further comprises an anionic surfactant. Typically, the anionic surfactant is the third surfactant as described and exemplified above. For example, the detergent composition can include LAS, AES, or combinations thereof, as the anionic surfactant. The anionic surfactant is typically present in an amount of from about 1 to about 9, more typically from about 1 to about 5, and most typically from about 3 to about 5, parts by weight, based on 100 parts by weight of the detergent composition. In one embodiment, the anionic surfactant is present in the detergent composition in an amount of about 3 parts by weight based on 100 parts by weight of the detergent composition.

The detergent composition further comprises an additive. In certain embodiments, the additive comprises at least one of a builder component, such as sodium bicarbonate and/or sodium carbonate, and a bleach component, such as a perborate bleach, e.g. sodium borate decahydrate ($NaBO_3.10H_2O$). In other words, the detergent composition can include the builder component only, the bleach component only, or a combination of the builder and bleach components. In the aforementioned embodiments, the additive is typically present in an amount of from about 1 to about 5 parts by weight based on 100 parts by weight of the detergent composition. In certain embodiments, the detergent composition includes about 1 part by weight of the builder component, and about 1 part by weight of the bleach component.

If employed, suitable graying inhibitors include, but are not limited to, polyesters of polyethylene oxides with ethylene glycol and/or propylene glycol and aromatic dicarboxylic acids or aromatic and aliphatic dicarboxylic acids, polyesters of polyethylene oxides terminally capped at one end with di- and/or polyhydric alcohols or dicarboxylic acids, and combinations thereof. If employed, suitable soil release polymers include, but are not limited to, amphiphilic graft polymers or copolymers of vinyl esters and/or acrylic esters onto polyalkylene oxides or modified celluloses, such as methylcellulose, hydroxypropylcellulose, and carboxymethylcellulose, and combinations thereof. If employed, suitable color transfer inhibitors include, but are not limited to, color transfer inhibitors, for example homopolymers and copolymers of vinylpyrrolidone, of vinylimidazole, of vinyloxazolidone and of 4-vinylpyridine N-oxide having number average molecular weights of from 15,000 to 100,000 g/mol. If employed, suitable foam inhibitors include, but are not limited to, organopolysiloxanes, silica, paraffins, waxes, microcrystalline waxes, and combinations thereof.

Other examples of suitable additives, for purposes of the present invention, include, but are not limited to, solvents such as ethylene glycol and isopropanol; enzymes; salts; graying inhibitors; polymers such as polyacrylates; copolymers such as copolymers of maleic acid and acrylic acid; color transfer inhibitors; bleach activators; bleach catalysts; foam inhibitors; complexing agents; optical brighteners; fragrances; perfumes; oils; preservatives; fillers; thickeners; inorganic extenders; formulation auxiliaries; solubility improvers; opacifiers; dyes; pigments; corrosion inhibitors; peroxide stabilizers; activators; catalysts; electrolytes; soaps; detergents; acids such as phosphoric acid, amidosulfonic acid, citric acid, lactic acid, acetic acid, peracids, and trichloroisocyanuric acid; chelating agents such as ethylenediaminetetraacetic acid (EDTA), N,N,N-nitrilotriacetic acid (NTA), and 2-methylglycine-N,N-diacetic acid (MGDA); phosphonates; alkali donors such as hydroxides; silicates; carbonates; oxidizing agents such as perborates; dichloroisocyanurates; interface-active ethyleneoxy adducts; and combinations thereof. The additive may be present in the detergent composition in various amounts.

The detergent composition further comprises water. The water is typically included in an amount of from about 1 to about 99, more typically from about 50 to about 95, and most typically from about 75 to about 92, parts by weight, based on 100 parts by weight of the detergent composition. Changing the amount of water present in detergent composition can change viscosity of the detergent composition, amongst changing other properties.

The detergent composition is typically a liquid. In these embodiments, the detergent composition typically has a viscosity of at least about 50, more typically at least about 75, yet more typically at least about 95, and most typically at least about 100, centipoise (cP) at 20° C. In certain embodiments, the detergent composition is a liquid. In these embodiments, the detergent composition typically has a viscosity of from about 50 to about 300, more typically from about 50 to about 200, and most typically from about 75 to about 150, cP at 20° C. The viscosity of the detergent composition may be determined by any method known in the art. For example, viscosity of the detergent composition may be measured using a Brookfield viscometer, a Shell cup, or a Zahn cup. In certain embodiments, the detergent composition has a viscosity higher than water, i.e., higher than 1 cP at 20° C., which is believed to be useful for influencing purchasing decisions by consumers of the detergent composition. In other words, if the detergent composition is "thicker" than water, it is believed that consumers will associate the detergent composition with superior properties such as cleaning power, and therefore are more likely to purchase, use, and repurchase the detergent composition.

While one form has been described above, i.e., liquid, the detergent composition may be of any form. For example, the detergent composition may be a solid such as a powder or pellet, a semi-solid such as a gel, or a liquid such as a light duty liquid (LDL) or a heavy duty liquid (HDL). As alluded to above, the detergent composition has various properties. These properties generally include: detergency, which is the ability to break the bond between soil and a surface; penetration and wetting, which allows water to surround soil particles that would otherwise repel the water; foaming, which creates bubbles that lift dirt from the surface; emulsification, which is ability to break up oil based soils into small droplets that can be dispersed thoroughly; solubilizing, which dissolves soil so that the soil is no longer a solid particle; and dispersing, which leads to spreading minute soil particles throughout a solution to prevent them from sticking to objects such as a mop, bucket or back onto a cleaned surface.

The cleaning composition is generally biodegradable; therefore, the cleaning composition may be chemically degraded via natural effectors such as soil bacteria, weather, plants and/or animals. The biodegradability of the cleaning composition reduces a possibility of pollution and formation of environmental hazards and is dependent on components of the cleaning composition. In addition, there may be a reduced risk to individuals who manufacture and use the cleaning composition in terms of chemical exposure. Typically, the cleaning composition substantially excludes, more typically completely excludes, an alkoxylated nonylphenol, specifically, nonylphenol ethoxylate (NPE).

The following examples, illustrating the cleaning compositions and the detergent compositions of the present invention, are intended to illustrate and not to limit the present invention.

EXAMPLES

A series of detergent compositions are prepared according to the present invention. Specifically, amounts of the surfactants are added to a vessel and mixed to prepare the detergent compositions. In addition to the surfactants, e.g. the cleaning composition, the detergent compositions further include a control load, which is described below. Two control detergent compositions (Control Examples 1 and 2 found below in Table I) are prepared for comparison with the Examples.

Viscosities of each of the Examples are determined at ~21° C. (70° F.) with a Brookfield viscometer set at a speed of 30 RPM, using a #2 spindle. Due to tolerances of the Brookfield viscometer, any viscosity values of zero in the tables below are about equal to the viscosity of water. Aqueous cloud points of the surfactants present in the Examples are determined by adding 1% by weight of the surfactant to water and heating until a visual change in appearance is noted such as a phase separation. Stability of the Examples is determined by allowing each of the Examples to sit undisturbed for 1 week. Any changes in appearance of the Examples after 1 week has passed are noted.

The amount and type of each component used to prepare the Examples are indicated in the tables below with all values in percent by weight based on the total weight of the respective Examples unless otherwise indicated.

TABLE I

| | Control Example | |
|---|---|---|
| | 1 | 2 |
| Component | | |
| Control Surfactant 1 | 3.3 | — |
| Control Surfactant 2 | — | 3.3 |
| Control Load | 96.7 | 96.7 |

TABLE I-continued

| | Control Example | |
|---|---|---|
| | 1 | 2 |
| Results | | |
| Viscosity (cP @ 70° F.) | 89.2 | 89.2 |
| Cloud Point (° C.) | 54.0 | 54.0 |

Control Surfactant 1 is a 100% active $C_9$ branched alcohol alkoxylated with 9 moles (average) of ethylene oxide.

Control Surfactant 2 is a 100% active $C_9$ branched alcohol, specifically a nonylphenol, alkoxylated with 9 moles (average) of ethylene oxide.

Control Load is a heavy duty liquid (HDL) detergent composition that lacks a primary active ingredient, specifically lacks a nonionic surfactant such as ethoxylated nonylphenol (NPE), e.g. Control Surfactant 2. Lacking the primary active ingredient, the Control Load comprises a linear alkyl sulfonate (LAS), water, and any combination of the following additives found in a typical HDL detergent composition: supplemental surfactants, a builder component, fragrance, a preservative, a perborate bleach component, a brightener, an enzyme, and a polymer.

Control Example 1 is a commercially available detergent composition, specifically, a HDL detergent composition that includes Control Surfactant 1 as the primary active ingredient, i.e., as the cleaning composition, and further includes the Control Load as the remainder of its formulation. Control Example 2 is prepared with the Control Load and Control Surfactant 2 to duplicate Control Example 1 for reproducibility purposes.

In Table II below, Surfactants 1-13 are added to the Control Load and mixed to prepare Examples 3-15.

Surfactant 1 is a 100% active $C_{10}$ branched alcohol ethoxylated with 9 moles (average) of ethylene oxide.

Surfactant 2 is a 100% active $C_{10}$ branched alcohol alkoxylated with 9 moles (average) of ethylene oxide.

Surfactant 3 is a 100% active $C_{10}$ branched alcohol alkoxylated with 3 moles (average) of ethylene oxide.

Surfactant 4 is a 100% active $C_{10}$ branched alcohol alkoxylated with 5 moles (average) of ethylene oxide.

Surfactant 5 is a 100% active $C_{12}$-$C_{14}$ linear alcohol blend alkoxylated with 7 moles (average) of ethylene oxide Surfactant 6 is a 100% active $C_{12}$-$C_{14}$ linear alcohol blend alkoxylated with 9 moles (average) of ethylene oxide.

Surfactant 7 is a 100% active $C_{12}$-$C_{14}$ linear alcohol blend alkoxylated with 6 moles (average) of ethylene oxide.

Surfactant 8 is a 100% active $C_{12}$-$C_{15}$ branched alcohol blend alkoxylated with 8 moles (average) of ethylene oxide.

Surfactant 9 is a 100% active $C_{13}$ branched alcohol alkoxylated with 6 moles (average) of ethylene oxide.

Surfactant 10 is a 100% active $C_{13}$ branched alcohol alkoxylated with 9 moles (average) of ethylene oxide.

Surfactant 11 is a 100% active $C_{13}$ branched alcohol alkoxylated with 5 moles (average) of ethylene oxide.

Surfactant 12 is a 100% active $C_{13}$-$C_{15}$ branched alcohol blend alkoxylated with 7 moles (average) of ethylene oxide.

Surfactant 13 is a 100% active $C_{13}$-$C_{15}$ branched alcohol blend alkoxylated with 8 moles (average) of ethylene oxide.

Example 11 is cloudy in appearance but stable over a 1 week time period. Example 14 is clear in appearance but unstable over a 1 week time period. Viscosities and cloud points of Example 3-15 are compared against Control Examples 1 and 2.

In Table III below, the Examples include blends of pre-alkoxylated surfactants, i.e., blends of the "first" and "second" surfactant. In other words, the surfactants are alkoxylated prior to blending/introduction to each other and then added to the Control Load to prepare Examples 16-24.

TABLE II

| | Example | | | | | | | | | | | | |
|---|---|---|---|---|---|---|---|---|---|---|---|---|---|
| | 3 | 4 | 5 | 6 | 7 | 8 | 9 | 10 | 11 | 12 | 13 | 14 | 15 |
| Component | | | | | | | | | | | | | |
| Surfactant 1 | 3.3 | — | — | — | — | — | — | — | — | — | — | — | — |
| Surfactant 2 | — | 3.3 | — | — | — | — | — | — | — | — | — | — | — |
| Surfactant 3 | — | — | 3.3 | — | — | — | — | — | — | — | — | — | — |
| Surfactant 4 | — | — | — | 3.3 | — | — | — | — | — | — | — | — | — |
| Surfactant 5 | — | — | — | — | 3.3 | — | — | — | — | — | — | — | — |
| Surfactant 6 | — | — | — | — | — | 3.3 | — | — | — | — | — | — | — |
| Surfactant 7 | — | — | — | — | — | — | 3.3 | — | — | — | — | — | — |
| Surfactant 8 | — | — | — | — | — | — | — | 3.3 | — | — | — | — | — |
| Surfactant 9 | — | — | — | — | — | — | — | — | 3.3 | — | — | — | — |
| Surfactant 10 | — | — | — | — | — | — | — | — | — | 3.3 | — | — | — |
| Surfactant 11 | — | — | — | — | — | — | — | — | — | — | 3.3 | — | — |
| Surfactant 12 | — | — | — | — | — | — | — | — | — | — | — | 3.3 | — |
| Surfactant 13 | — | — | — | — | — | — | — | — | — | — | — | — | 3.3 |
| Control Load | 96.7 | 96.7 | 96.7 | 96.7 | 96.7 | 96.7 | 96.7 | 96.7 | 96.7 | 96.7 | 96.7 | 96.7 | 96.7 |
| Results | | | | | | | | | | | | | |
| Viscosity (cP @ 70° F.) | 0.0 | 0.0 | 19.5 | 0.0 | 47.1 | 0.0 | 5.0 | 27.0 | 102.0 | 23.0 | 0.0 | 70.1 | 5.0 |
| Cloud Point (° C.) | 69.0 | 77.0 | — | — | 50.0 | 75.0 | — | — | 41.0 | 58.0 | — | 43.0 | 52.0 |

TABLE III

| | Example | | | | | | | | |
|---|---|---|---|---|---|---|---|---|---|
| | 16 | 17 | 18 | 19 | 20 | 21 | 22 | 23 | 24 |
| Component | | | | | | | | | |
| Surfactant 1 | — | — | — | — | — | — | — | — | — |
| Surfactant 2 | — | — | — | — | — | — | — | — | — |
| Surfactant 3 | 0.66 | — | — | — | — | 0.33 | — | — | — |
| Surfactant 4 | — | — | 1.65 | — | — | — | — | — | — |
| Surfactant 5 | 2.64 | 2.64 | 1.65 | 2.97 | 1.65 | 2.97 | 1.65 | 2.64 | 2.64 |
| Surfactant 6 | — | — | — | — | — | — | — | — | — |
| Surfactant 7 | — | — | — | — | — | — | — | — | — |
| Surfactant 8 | — | — | — | — | — | — | — | — | — |
| Surfactant 9 | — | — | — | — | 1.65 | — | — | — | — |
| Surfactant 10 | — | — | — | — | — | — | — | — | — |
| Surfactant 11 | — | — | — | — | — | — | — | — | — |
| Surfactant 12 | — | 0.66 | — | 0.33 | — | — | — | — | — |
| Surfactant 13 | — | — | — | — | — | — | — | — | — |
| Surfactant 14 | — | — | — | — | — | — | 1.65 | 0.66 | — |
| Surfactant 15 | — | — | — | — | — | — | — | — | 0.66 |
| Control Load | 96.7 | 96.7 | 96.7 | 96.7 | 96.7 | 96.7 | 96.7 | 96.7 | 96.7 |
| Results | | | | | | | | | |
| Viscosity (cP @ 70° F.) | 91.8 | 71.1 | 66.1 | 62.1 | 57.6 | 55.1 | 53.1 | 46.1 | 31.9 |

Surfactant 14 is a 100% active $C_{10}$ branched alcohol alkoxylated with 5 moles (average) of ethylene oxide.

Surfactant 15 is a 100% active $C_{10}$ branched alcohol alkoxylated with 7 moles (average) of ethylene oxide.

Example 16 is unstable. Examples 17 and 20 are clear in appearance. Example 21 is unstable. Viscosities and cloud points of Examples 16-24 are compared against Control Examples 1 and 2.

In Table IV below, some of the Examples include blends of post-alkoxylated alcohols, specifically, Examples 25-30. In other words, in these Examples, the alcohols are alkoxylated after blending/introduction with each other to form the surfactants, i.e., the first and second surfactants, which are then added to the Control Load to prepare Examples 25-30. The remaining Examples also include post-alkoxylated alcohols, specifically, Examples 31 and 32; however, these alcohols are not blended with other alcohols prior to alkoxylating to form a surfactant. The surfactant is then added to the Control Load to prepare Examples 31 and 32.

To prepare Examples 25-30, amounts of a first aliphatic alcohol and a second aliphatic alcohol are added to a vessel and mixed. Subsequently, potassium hydroxide (KOH) as a catalyst (i.e., a metal catalyst) is added to the vessel and mixed with the first aliphatic alcohol and the second aliphatic alcohol to form a mixture. The mixture is heated to 85° C. and agitated for 1 hour. Subsequently, the mixture is heated to 110° C. and adjusted to a pressure of approximately 90 psig. Then, ethylene oxide is added to the mixture to react with the first aliphatic alcohol and the second aliphatic alcohol, thereby forming the respective first surfactant, the second surfactant. The temperature of the mixture is allowed to increase to approximately 145° C. After formation of the first surfactant, second surfactant, and polyethylene glycol, the temperature of the vessel is lowered to approximately 80° C. The Control Load is then added and mixed in the vessel to prepare the example. Examples 31 and 32 are prepared as like described above without adding the second aliphatic alcohol.

TABLE IV

| | Example | | | | | | | |
|---|---|---|---|---|---|---|---|---|
| | 25 | 26 | 27 | 28 | 29 | 30 | 31 | 32 |
| Component | | | | | | | | |
| Alcohol 16 | 0.66 | 2.64 | 1.98 | 1.98 | — | — | — | — |
| Alcohol 17 | 2.64 | 0.33 | 1.32 | 1.32 | 2.64 | 2.64 | 3.30 | 3.30 |
| Alcohol 18 | — | — | — | — | 0.33 | 0.33 | — | — |
| Control Load | 96.7 | 96.7 | 96.7 | 96.7 | 96.7 | 96.7 | 96.7 | 96.7 |
| Results | | | | | | | | |
| Viscosity (cP @ 70° F.) | 19.5 | 15.0 | 0.0 | 0.0 | 80.0 | 36.1 | 70.1 | 57.1 |

Alcohol 16 is 2-propylheptanol (2-PH).

Alcohol 17 is a $C_{12}$-$C_{14}$ linear alcohol blend.

Alcohol 18 is a $C_{13}$-$C_{15}$ branched alcohol blend.

The alcohols of Examples 25-32 are alkoxylated as previously described above. The alcohols of Example 25 are alkoxylated with 8 moles (average) of ethylene oxide. The alcohols of Example 26 are alkoxylated with 8 moles (average) of ethylene oxide. The alcohols of Example 27 are alkoxylated with 5 moles (average) of ethylene oxide. The alcohols of Example 28 are alkoxylated with 9 moles (average) of ethylene oxide. The alcohols of Example 29 are alkoxylated with 6 moles (average) of ethylene oxide. The alcohols of Example 30 are alkoxylated with 6.5 moles (average) of ethylene oxide. The alcohol of Example 31 is alkoxylated with 5 moles (average) of ethylene oxide. The alcohol of Example 32 is alkoxylated with 5.5 moles (average) of ethylene oxide.

Examples 29 and 32 are clear in appearance. Example 31 is cloudy in appearance. Viscosities and cloud points of Examples 25-32 are compared against Control Examples 1 and 2.

An additional series of detergent compositions are prepared according to the present invention. Specifically, amounts of the surfactants are added to a vessel and mixed to prepare the detergent compositions. The amount and type of each component used to prepare the Examples are indicated in Table V below with all values in percent by weight based on the total weight of the Examples unless otherwise indicated.

TABLE V

| | Example | | | |
|---|---|---|---|---|
| | 33 | 34 | 35 | 36 |
| Component | | | | |
| Nonionic Surfactant | | | | |
| Surfactant 5 | 6.00 | — | — | — |
| Surfactant 16 | — | — | 6.00 | — |
| Surfactant 17 | — | — | — | 6.00 |
| Surfactant 18 | — | 6.00 | — | — |
| Builder Component | | | | |
| Builder 1 | 1.00 | 1.00 | 1.00 | 1.00 |
| Bleach Component | | | | |
| Bleach 1 | 1.00 | 1.00 | 1.00 | 1.00 |
| Water | 92.0 | 92.0 | 92.0 | 92.0 |
| Total | 100 | 100 | 100 | 100 |
| Viscosity (cps, spindle #2) | 2 | 6 | 64 | 518 |
| pH, "as is" | 10 | 10 | 10 | 10 |
| Stability (R.T.) | Stable/ Clear | Stable/ Clear | Stable/ Clear | Stable/ Clear |

Surfactant 16 is a mixture of 80 percent (by weight) of Alcohol 17 and 20 percent (by weight) of Alcohol 18, which is alkoxylated with 6 moles (average) of ethylene oxide after combining the surfactants, as like described above with Examples 25-30.

Surfactant 17 is a $C_{14}$-$C_{15}$ slightly branched alcohol blend, alkoxylated with 7 moles (average) of ethylene oxide.

Surfactant 18 is a $C_{12}$-$C_{15}$ slightly branched alcohol blend, alkoxylated with 7 moles (average) of ethylene oxide.

Builder 1 is sodium carbonate ($NaHCO_3$).

Bleach 1 is sodium borate decahydrate ($NaBO_3.10H_2O$).

Referring to the Figures, FIG. 1 is a bar chart illustrating viscosities of Examples 33-36. While Example 36 has high viscosity, i.e., 518 cps, Surfactant 17 alone sacrifices benefits of anionic detergency profile. Generally, it is believed that a detergency profile of anionic surfactants provides better cleaning on particulate soils than nonionic surfactants, but poorer performance on oily soils than nonionic surfactants. The corresponding Examples illustrated in FIG. 1 can be better appreciated by reference to Table V above.

Additional detergent compositions are prepared to develop viscosity trends of the detergent compositions, based upon specific surfactants employed, and amounts and ratios thereof. These detergent compositions are illustrated in the tables below.

TABLE VI

| | Example | | | | |
|---|---|---|---|---|---|
| | 37 | 38 | 39 | 40 | 41 |
| Component | | | | | |
| Anionic Surfactant | | | | | |
| Surfactant 19 | 1.00 | 2.00 | 2.50 | 3.00 | 4.00 |

TABLE VI-continued

| | Example | | | | |
|---|---|---|---|---|---|
| | 37 | 38 | 39 | 40 | 41 |
| Nonionic Surfactant | | | | | |
| Surfactant 5 | — | — | — | — | — |
| Surfactant 16 | 1.00 | 2.00 | 2.50 | 3.00 | 2.00 |
| Surfactant 17 | — | — | — | — | — |
| Surfactant 18 | — | — | — | — | — |
| Builder Component | | | | | |
| Builder 1 | 1.00 | 1.00 | 1.00 | 1.00 | 1.00 |
| Bleach Component | | | | | |
| Bleach 1 | 1.00 | 1.00 | 1.00 | 1.00 | 1.00 |
| Water | 96.0 | 94.0 | 92.0 | 92.0 | 92.0 |
| Total | 100 | 100 | 99 | 100 | 100 |
| viscosity (cps, spindle #2) | 4 | 25 | 54.6 | 98 | 84 |
| pH, "as is" | 10 | 10 | 10 | 10.1 | 10.1 |
| Stability (R.T.) | Stable/ Clear | Stable/ Clear | Stable/ Clear | Stable/ Clear | Stable/ Clear |

Surfactant 19 is a linear alkylbenzene sulfonate (LAS). Example 40 has excellent viscosity, detergency, and solubility relative to the other Examples in Table VI. Example 41 also has similar properties, as also illustrated above.

TABLE VII

| | Example | | | | |
|---|---|---|---|---|---|
| | 42 | 43 | 44 | 45 | 46 |
| Component | | | | | |
| Anionic Surfactant | | | | | |
| Surfactant 19 | 2.00 | 5.00 | 1.00 | 4.50 | 1.50 |
| Nonionic Surfactant | | | | | |
| Surfactant 5 | — | — | — | — | — |
| Surfactant 16 | 4.00 | 1.00 | 5.00 | 1.50 | 4.50 |
| Surfactant 17 | — | — | — | — | — |
| Surfactant 18 | — | — | — | — | — |
| Builder Component | | | | | |
| Builder 1 | 1.00 | 1.00 | 1.00 | 1.00 | 1.00 |
| Bleach Component | | | | | |
| Bleach 1 | 1.00 | 1.00 | 1.00 | 1.00 | 1.00 |
| Water | 92.0 | 92.0 | 92.0 | 91.0 | 91.0 |
| Total | 100 | 100 | 100 | 99 | 99 |
| viscosity (cps, spindle #2) | 121 | 33 | 132 | 68 | 133 |
| pH, "as is" | 10.1 | 10 | 10.1 | 10 | 10.1 |
| Stability (R.T.) | Stable/Clear | Stable/ Clear | Stable/ Clear | Stable/ Clear | Stable/ Clear |

Examples 42, 44, and 46 have excellent viscosities, as illustrated above in Table VII.

TABLE VIII

| | Example | | | | | |
|---|---|---|---|---|---|---|
| | 47 | 48 | 49 | 50 | 51 | 52 |
| Component | | | | | | |
| Anionic Surfactant | | | | | | |
| Surfactant 19 | 4.00 | 5.00 | 6.00 | 7.00 | 8.00 | 9.00 |

TABLE VIII-continued

| | Example | | | | | |
|---|---|---|---|---|---|---|
| | 47 | 48 | 49 | 50 | 51 | 52 |
| Nonionic Surfactant | | | | | | |
| Surfactant 5 | — | — | — | — | — | — |
| Surfactant 16 | 4.00 | 5.00 | 6.00 | 7.00 | 8.00 | 9.00 |
| Surfactant 17 | — | — | — | — | — | — |
| Surfactant 18 | — | — | — | — | — | — |
| Builder Component | | | | | | |
| Builder 1 | 1.00 | 1.00 | 1.00 | 1.00 | 1.00 | 1.00 |
| Bleach Component | | | | | | |
| Bleach 1 | 1.00 | 1.00 | 1.00 | 1.00 | 1.00 | 1.00 |
| Water | 90.0 | 88.0 | 86.0 | 84.0 | 82.0 | 80.0 |
| Total | 100 | 100 | 100 | 100 | 100 | 100 |
| viscosity (cps, spindle #2) | 166 | 224 | 239 | 242 | 234 | 209 |
| pH, "as is" | 10 | 10 | 10 | 10 | 10 | 10 |
| Stability (R.T.) | Stable/ Clear | Stable/ Clear | Stable/ Clear | Stable/ Clear | Stable/ Clear | Stable/ Clear |

Examples 47-52 have excellent viscosities, as illustrated above in Table VIII.

Figure 2:
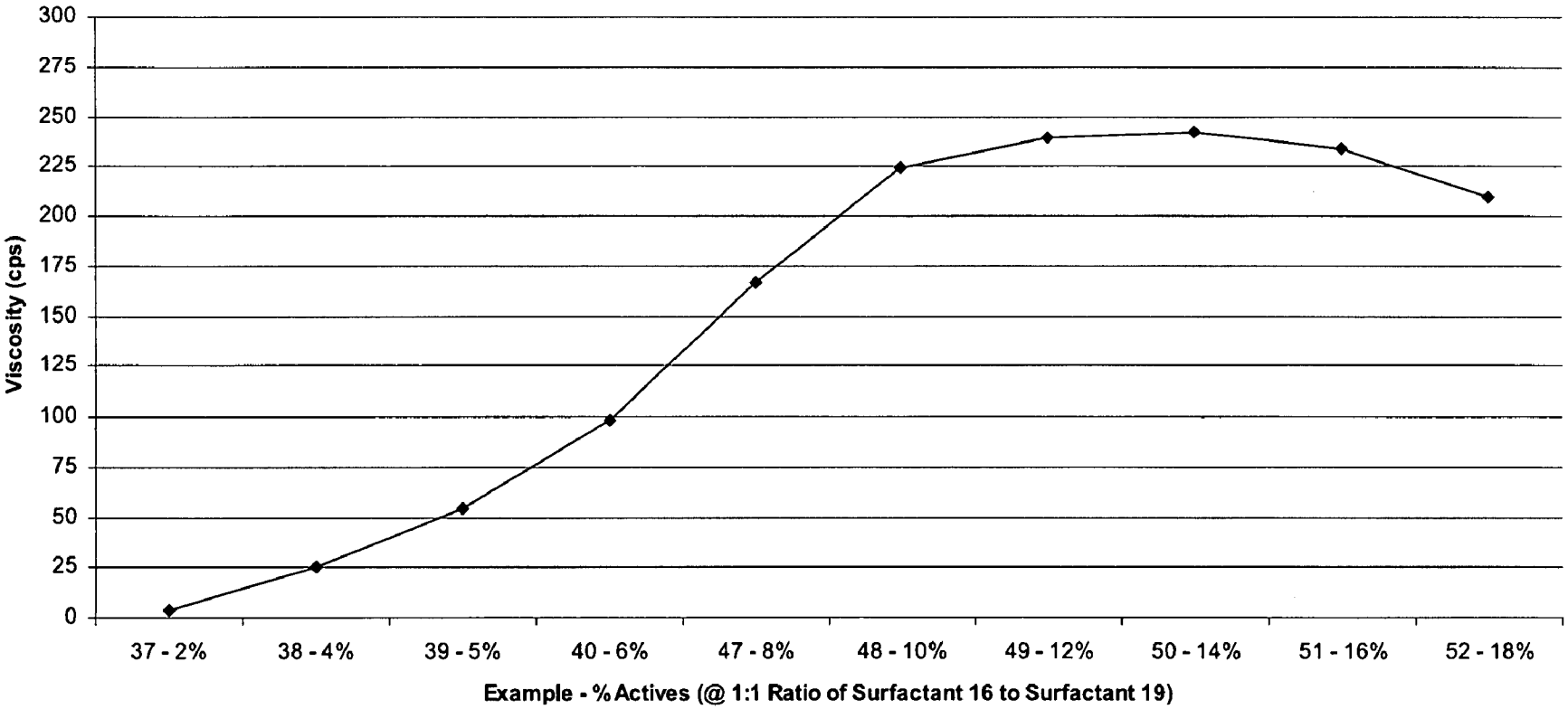
FIG. 2 is a line graph illustrating a viscosity trend of detergent compositions as a function of percent actives present in the detergent compositions at a weight ratio of 1:1 nonionic to anionic surfactants (Surfactant 16 to Surfactant 19) present in the detergent compositions.

Referring to the Figures, FIG. 2 is a line graph illustrating a viscosity trend of the detergent compositions as a function of percent actives present in the detergent compositions at a weight ratio of 1:1 nonionic to anionic surfactants present in the detergent compositions. Surprisingly, viscosity of the detergent compositions drastically increases from about 2% to about 14% actives (total % of anionic and anionic surfactants by weight, @ a weight ratio of 1:1—Surfactant 16 to Surfactant 19), with the most dramatic increase in viscosity from about 5% to about 10% actives (by weight). It is to be appreciated that Examples 41-46 are excluded because they do not have the 1:1 weight ratio as described above.

Figure 3:
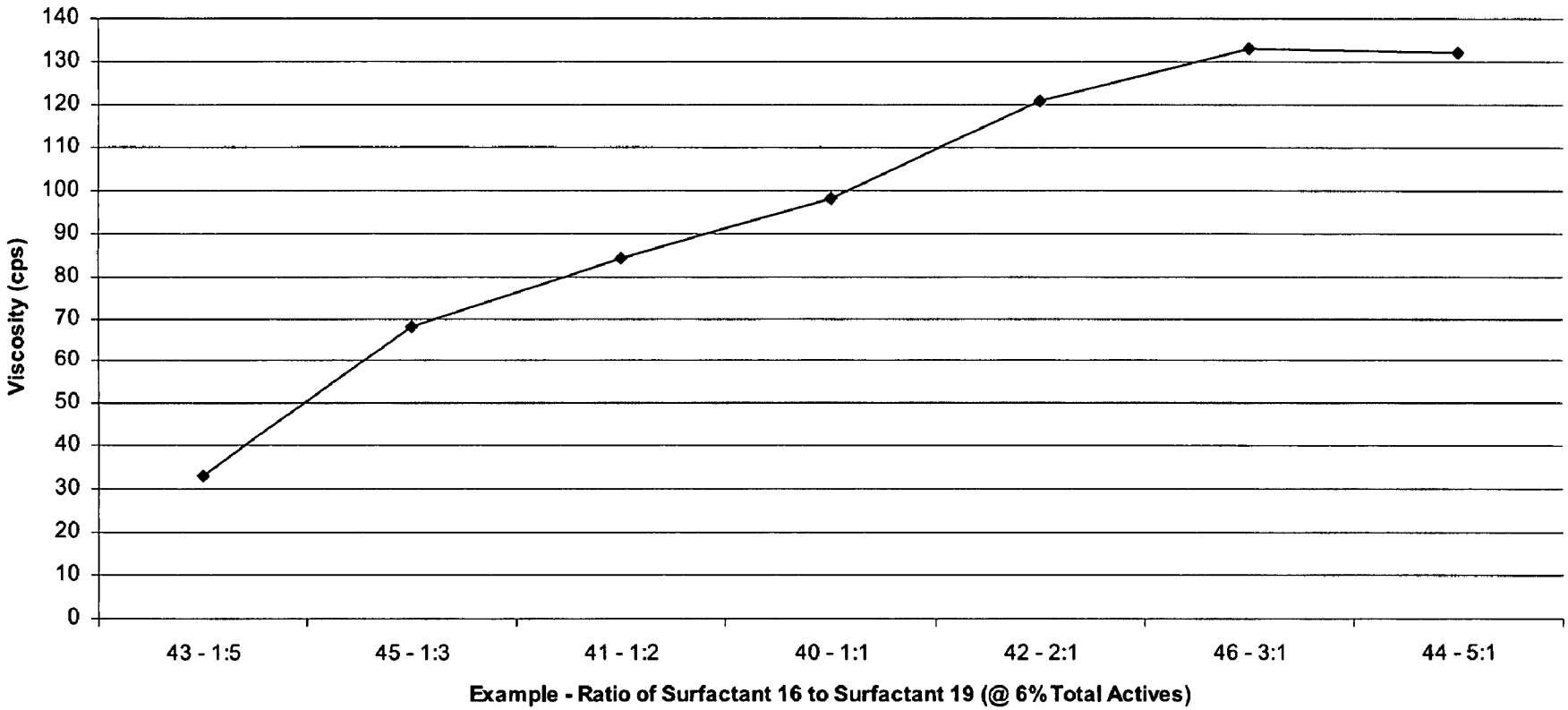
FIG. 3 is a line graph a viscosity trend of detergent compositions as a function of a weight ratio of nonionic to anionic surfactants present in the detergent compositions (@6 wt % total actives)

FIG. 3 is a line graph illustrating a viscosity trend of detergent compositions as a function of a weight ratio of nonionic to anionic surfactants present in the detergent compositions. Surprisingly, viscosity of the detergent compositions drastically increases from a weight ratio of about 1:5 to about 3:1 (Surfactant 16 to Surfactant 19), with the most dramatic increase in viscosity from a weight ratio of about 1:1 to about 3:1 (Surfactant 16 to Surfactant 19). The corresponding Examples illustrated in FIGS. 2 and 3 can be better appreciated by reference to the tables above.

The two tables below illustrate detergent compositions lacking Surfactant 16, which is a cleaning composition of the present invention. Surfactant 19 can be considered the "third" surfactant of the present invention.

TABLE IX

| | Example | | | | |
|---|---|---|---|---|---|
| | 53 | 54 | 55 | 56 | 57 |
| Component Anionic Surfactant | | | | | |
| Surfactant 19 | 3.00 | 3.00 | 3.00 | 3.00 | 3.00 |

TABLE IX-continued

| | Example | | | | |
|---|---|---|---|---|---|
| | 53 | 54 | 55 | 56 | 57 |
| Nonionic Surfactant | | | | | |
| Surfactant 5 | — | — | — | 2.40 | 0.60 |
| Surfactant 16 | — | — | — | — | — |
| Surfactant 17 | 2.40 | 0.60 | 1.50 | 0.60 | 2.40 |
| Surfactant 18 | 0.60 | 2.40 | 1.50 | — | — |
| Builder Component | | | | | |
| Builder 1 | 1.00 | 1.00 | 1.00 | 1.00 | 1.00 |
| Bleach Component | | | | | |
| Bleach 1 | 1.00 | 1.00 | 1.00 | 1.00 | 1.00 |
| Water | 92.0 | 92.0 | 92.0 | 92.0 | 92.0 |
| Total | 100 | 100 | 100 | 100 | 100 |
| viscosity (cps, spindle #2) | 17 | 11 | 14 | 9 | 16 |
| pH, "as is" | 10 | 10 | 10 | 10 | 10 |
| Stability (R.T.) | Stable/Clear | Stable/ Clear | Stable/ Clear | Stable/ Clear | Stable/ Clear |

The viscosities of the Examples above are very low, as illustrated above in Table IX.

TABLE X

| | Example | | | | |
|---|---|---|---|---|---|
| | 58 | 59 | 60 | 61 | 62 |
| Component Anionic Surfactant | | | | | |
| Surfactant 19 | 3.00 | 3.00 | 3.00 | 3.00 | 3.00 |
| Nonionic Surfactant | | | | | |
| Surfactant 5 | 1.50 | 2.40 | 0.60 | 1.50 | — |
| Surfactant 16 | — | — | — | — | — |
| Surfactant 17 | 1.50 | | | | 3.00 |
| Surfactant 18 | — | 0.60 | 2.40 | 1.50 | — |
| Builder Component | | | | | |
| Builder 1 | 1.00 | 1.00 | 1.00 | 1.00 | 1.00 |
| Bleach Component | | | | | |
| Bleach 1 | 1.00 | 1.00 | 1.00 | 1.00 | 1.00 |
| Water | 92.0 | 92.0 | 92.0 | 92.0 | 92.0 |
| Total | 100 | 100 | 100 | 100 | 100 |
| viscosity (cps, spindle #2) | 10 | 9 | 10 | 9 | 25 |
| pH, "as is" | 10 | 10 | 10 | 10 | 10 |
| Stability (R.T.) | Stable/Clear | Stable/ Clear | Stable/ Clear | Stable/ Clear | Stable/ Clear |

The viscosities of the Examples above are very low, as illustrated above in Table X.

TABLE XI

| | Example | | | | |
|---|---|---|---|---|---|
| | 63 | 64 | 65 | 66 | 67 |
| Component Anionic Surfactant | | | | | |
| Surfactant 19 | 0.50 | 1.00 | 1.25 | 1.50 | 2.00 |
| Nonionic Surfactant | | | | | |
| Surfactant 5 | — | — | — | — | — |

TABLE XI-continued

| | Example | | | | |
|---|---|---|---|---|---|
| | 63 | 64 | 65 | 66 | 67 |
| Surfactant 16 | 1.50 | 3.00 | 3.75 | 4.50 | 6.00 |
| Surfactant 17 | — | — | — | — | — |
| Surfactant 18 | — | — | — | — | — |
| Builder Component | | | | | |
| Builder 1 | 1.00 | 1.00 | 1.00 | 1.00 | 1.00 |
| Bleach Component | | | | | |
| Bleach 1 | 1.00 | 1.00 | 1.00 | 1.00 | 1.00 |
| Water | 96.0 | 94.0 | 93.0 | 92.0 | 90.0 |
| Total | 100 | 100 | 100 | 100 | 100 |
| viscosity (cps, spindle #2) | 10 | 56.6 | 93.5 | 133 | 200 |
| pH, "as is" | 10 | 10 | 10 | 10 | 10 |
| Stability (R.T.) | Clear/Stable | Clear/ Stable | Clear/ Stable | Clear/ Stable | Clear/ Stable |

TABLE XII

| | Example | | | | |
|---|---|---|---|---|---|
| | 68 | 69 | 70 | 71 | 72 |
| Component | | | | | |
| Anionic Surfactant | | | | | |
| Surfactant 19 | 2.50 | 3.00 | 3.50 | 4.00 | 4.50 |
| Nonionic Surfactant | | | | | |
| Surfactant 5 | — | — | — | — | — |
| Surfactant 16 | 7.50 | 9.00 | 10.50 | 12.00 | 13.50 |
| Surfactant 17 | — | — | — | — | — |
| Surfactant 18 | — | — | — | — | — |
| Builder Component | | | | | |
| Builder 1 | 1.00 | 1.00 | 1.00 | 1.00 | 1.00 |
| Bleach Component | | | | | |
| Bleach 1 | 1.00 | 1.00 | 1.00 | 1.00 | 1.00 |
| Water | 88.0 | 86.0 | 84.0 | 82.0 | 80.0 |
| Total | 100 | 100 | 100 | 100 | 100 |
| viscosity (cps, spindle #2) | 240 | 265 | 270 | 284 | 254 |
| pH, "as is" | 10 | 10.1 | 10.2 | 10.1 | 10.1 |
| Stability (R.T.) | Clear/Stable | Clear/ Stable | Clear/ Stable | Clear/ Stable | Clear/ Stable/ |

Figure 4:
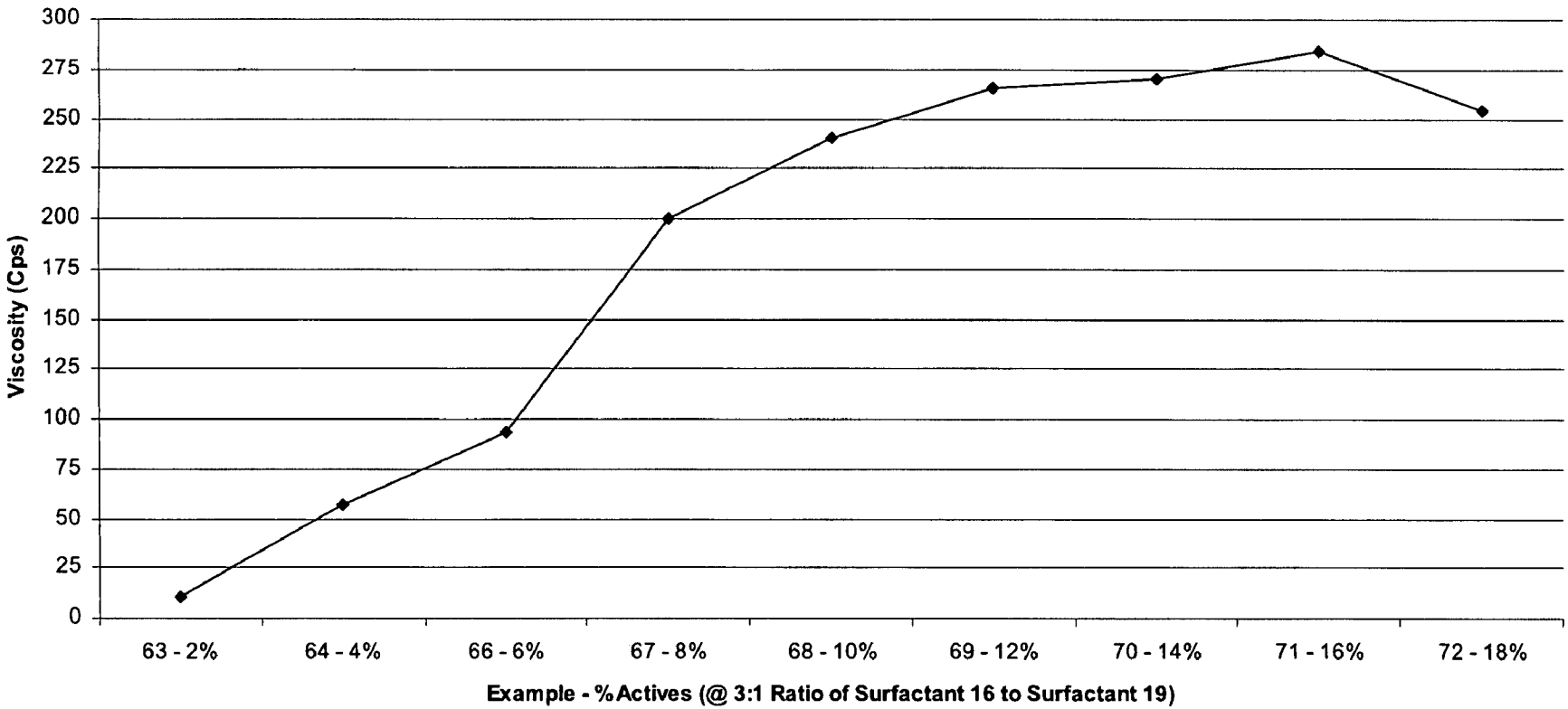
FIG. 4 is a line graph illustrating a viscosity trend of detergent compositions as a function of percent actives (by wt %) present in the detergent compositions at a weight ratio of 3:1 nonionic to anionic surfactants (Surfactant 16 to Surfactant 19) present in the detergent compositions.

Referring to the Figures, FIG. 4 is a line graph illustrating a viscosity trend of detergent compositions as a function of percent actives present in the detergent compositions at a weight ratio of 3:1 nonionic to anionic surfactants present in the detergent compositions. Surprisingly, viscosity of the detergent compositions drastically increases from about 2% to about 16% actives (total % of anionic and anionic surfactants by weight, @ a weight ratio of 3:1—Surfactant 16 to Surfactant 19), with the most dramatic increase in viscosity from about 6% to about 8% actives (by weight). It is to be appreciated that Example 65 is excluded from FIG. 4 because it included an odd number, i.e., 5, for its % actives.

Figure 5:
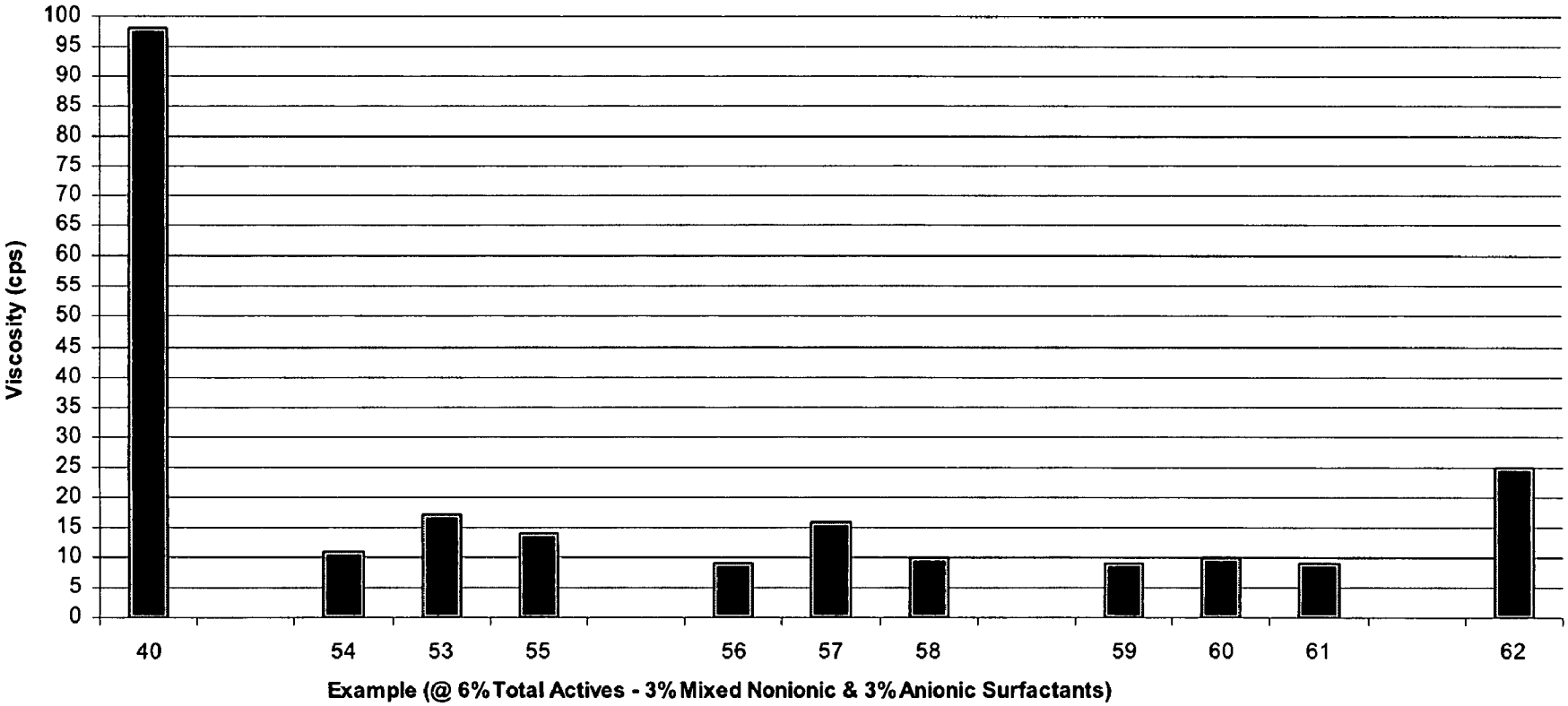
FIG. 5 is a bar chart illustrating viscosities of Example 40 and Examples 53-62 (@6 wt % total actives)

FIG. 5 is a bar chart illustrating viscosities of Example 40 and Examples 53-62. Surprisingly, Example 40 has a much higher viscosity relative to the other Examples which have various blends of nonionic surfactants (at 3% by weight) with 3% by weight LAS. The corresponding Examples illustrated in FIGS. 4 and 5 can be better appreciated by reference to the tables above.

TABLE XIII

| | Example | | | | |
|---|---|---|---|---|---|
| | 73 | 74 | 75 | 76 | 77 |
| Component | | | | | |
| Anionic Surfactant | | | | | |
| Surfactant 20 | — | — | — | 1.00 | 2.00 |
| Surfactant 21 | 1.00 | 2.00 | 3.00 | — | — |
| Nonionic Surfactant | | | | | |
| Surfactant 5 | | | | | |
| Surfactant 16 | 5.00 | 6.00 | 3.00 | 1.00 | 2.00 |
| Surfactant 17 | — | — | — | — | — |
| Surfactant 18 | — | — | — | — | — |
| Surfactant 22 | — | — | — | — | — |
| Builder Component | | | | | |
| Builder 1 | 1.00 | 1.00 | 1.00 | 1.00 | 1.00 |
| Bleach Component | | | | | |
| Bleach 1 | 1.00 | 1.00 | 1.00 | 1.00 | 1.00 |
| Water | 92.0 | 90.0 | 92.0 | 96.0 | 94.0 |
| Total | 100 | 100 | 100 | 100 | 100 |
| viscosity (cps, spindle #2) | 73.5 | 45.1 | 7.5 | 0 | 2 |
| pH, "as is" | 10.1 | 10 | 10 | 10 | 10 |
| Stability (R.T.) | Stable/Clear | Stable/ Clear | Stable/ Clear | Stable/ Clear | Stable/ Clear |

Surfactant 20 is an alkyl ether sulfate (AES) alkoxylated with 3 moles of ethylene oxide.

Surfactant 21 is an alkyl ether sulfate (AES) alkoxylated with 2 moles of ethylene oxide.

Surfactant 22 is a stearyl $C_{16}$-$C_{18}$ alcohol ethoxylate having 55 moles of ethylene oxide.

TABLE XIV

| | Example | | | | |
|---|---|---|---|---|---|
| | 78 | 79 | 80 | 81 | 82 |
| Component | | | | | |
| Anionic Surfactant | | | | | |
| Surfactant 20 | 3.00 | 1.00 | 2.00 | 6.00 | 6.00 |
| Surfactant 21 | — | — | — | — | — |
| Nonionic Surfactant | | | | | |
| Surfactant 5 | | | | | |
| Surfactant 16 | 3.00 | 5.00 | 4.00 | 1.50 | 3.00 |
| Surfactant 17 | — | — | — | — | — |
| Surfactant 18 | — | — | — | — | — |
| Surfactant 22 | — | — | — | 1.50 | — |
| Builder Component | | | | | |
| Builder 1 | 1.00 | 1.00 | 1.00 | 1.00 | 1.00 |
| Bleach Component | | | | | |
| Bleach 1 | 1.00 | 1.00 | 1.00 | 1.00 | 1.00 |
| Water | 92.0 | 92.0 | 92.0 | 89.0 | 89.0 |
| Total | 100 | 100 | 100 | 100 | 100 |
| viscosity (cps, spindle #2) | 4 | 88.5 | 20.5 | 4.5 | 2.5 |
| pH, "as is" | 10 | 10.1 | 10 | 10.1 | 10 |
| Stability (R.T.) | Stable/Clear | Stable/ Clear | Stable/ Clear | Stable/ Clear | Stable/ Clear |

TABLE XV

| | Example | | | | |
|---|---|---|---|---|---|
| | 83 | 84 | 85 | 86 | 87 |
| Component | | | | | |
| Anionic Surfactant | | | | | |
| Surfactant 20 | 6.00 | 3.00 | 3.00 | 4.00 | 5.00 |
| Surfactant 21 | — | — | — | — | — |
| Nonionic Surfactant | | | | | |
| Surfactant 5 | 6.00 | — | — | — | — |
| Surfactant 16 | — | — | — | 4.00 | 5.00 |
| Surfactant 17 | — | 3.00 | — | — | — |
| Surfactant 18 | — | — | 3.00 | — | — |
| Surfactant 22 | — | — | — | — | — |
| Builder Component | | | | | |
| Builder 1 | 1.00 | 1.00 | 1.00 | 1.00 | 1.00 |
| Bleach Component | | | | | |
| Bleach 1 | 1.00 | 1.00 | 1.00 | 1.00 | 1.00 |
| Water | 86.0 | 92.0 | 92.0 | 90.0 | 88.0 |
| Total | 100 | 100 | 100 | 100 | 100 |
| viscosity (cps, spindle #2) | 0 | 0 | 0 | 8 | 15 |
| pH, "as is" | 10 | 10 | 10 | 10 | 10 |
| Stability (R.T.) | Stable/Clear | Stable/ Clear | Stable/ Clear | Stable/ Clear | Stable/ Clear |

TABLE XVI

| | Example | | | |
|---|---|---|---|---|
| | 88 | 89 | 90 | 91 |
| Component | | | | |
| Anionic Surfactant | | | | |
| Surfactant 20 | 6.00 | 7.00 | 8.00 | 9.00 |
| Surfactant 21 | — | — | — | — |
| Nonionic Surfactant | | | | |
| Surfactant 5 | — | — | — | — |
| Surfactant 16 | 6.00 | 7.00 | 8.00 | 9.00 |
| Surfactant 17 | — | — | — | — |
| Surfactant 18 | — | — | — | — |
| Surfactant 22 | — | — | — | — |
| Builder Component | | | | |
| Builder 1 | 1.00 | 1.00 | 1.00 | 1.00 |
| Bleach Component | | | | |
| Bleach 1 | 1.00 | 1.00 | 1.00 | 1.00 |
| Water | 86.0 | 84.0 | 82.0 | 80.0 |
| Total | 100 | 100 | 100 | 100 |
| viscosity (cps, spindle #2) | 26 | 55 | 109 | 225 |
| pH, "as is" | 10 | 10 | 10 | 10 |
| Stability (R.T.) | Stable/ Clear | Stable/ Clear | Stable/ Clear | Stable/ Clear |

Figure 6:
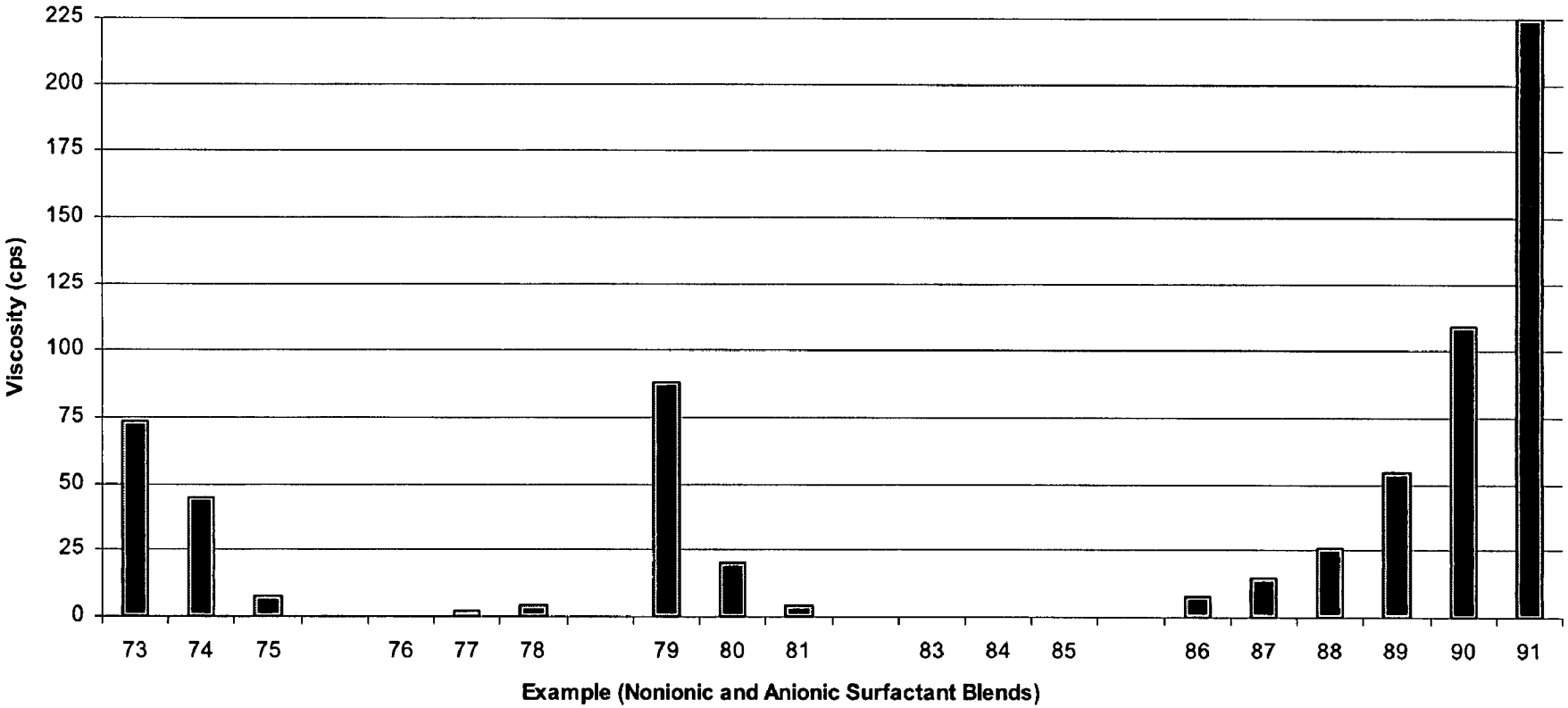
FIG. 6 is a bar chart illustrating viscosities of Examples 73-81 and Examples 83-91.

FIG. 6 is a bar chart illustrating viscosities of Examples 73-81 and Examples 83-91. Surprisingly, relative to employing LAS as illustrated in FIG. 5, employing AES tends in place of LAS tends to lower viscosity of the detergent compositions. While excluded from FIG. 6, Example 82 has a viscosity of 2.5 cps, as shown in Table XIV. The corresponding Examples illustrated in FIG. 6 can be better appreciated by reference to the tables above.

Detergency evaluations are performed on a few of the examples according to methods known in the art. Delta E* for the various examples are illustrated in the two tables below.

As understood in the art, Delta E* units describe the improvement in cleaning from before washing to after washing.

TABLE XVII

| | Example | | | |
|---|---|---|---|---|
| | 92 | 93 | 94 | 95 |
| | Surfactant No. | | | |
| Material/Substrate | Control 1 | 5 | 12 | 23 |
| | Delta E* | | | |
| Sebum/Cotton | 9.60 | 9.52 | 9.23 | 9.36 |
| Sebum/Blend | 8.99 | 9.06 | 8.74 | 9.13 |
| Make-up/Blend | 34.60 | 35.01 | 35.08 | 34.88 |
| Humus/Blend | 27.83 | 27.80 | 26.53 | 27.38 |
| Black Charm/Cotton | 11.06 | 11.70 | 11.37 | 11.74 |
| Black Charm/Blend | 17.39 | 17.22 | 17.42 | 17.34 |
| Coffee/Blend | 19.13 | 19.01 | 18.67 | 18.85 |
| Blueberry/Cotton | 21.00 | 20.91 | 20.58 | 20.45 |
| Grape Juice/Blend | 41.40 | 41.90 | 42.21 | 41.80 |
| Blood/Cotton | 1.96 | 1.90 | 1.97 | 2.00 |
| Grass/Blend | 7.75 | 7.49 | 8.24 | 7.88 |
| Chocolate/Blend | 19.89 | 20.06 | 19.35 | 19.63 |

Surfactant 23 is a $C_{15}$-$C_{17}$ branched alcohol blend, alkoxylated with 7 moles (average) of ethylene oxide.

TABLE XVIII

| | Example | | | |
|---|---|---|---|---|
| | 96 | 97 | 98 | 99 |
| | Surfactant No. | | | |
| Material/Substrate | 24 | 25 | 16 | 26 |
| | Delta E* | | | |
| Sebum/Cotton | 8.86 | 9.29 | 9.51 | 9.35 |
| Sebum/Blend | 8.86 | 9.08 | 9.08 | 9.04 |
| Make-up/Blend | 35.14 | 35.38 | 34.76 | 35.08 |
| Humus/Blend | 28.33 | 27.79 | 27.66 | 27.41 |
| Black Charm/Cotton | 12.02 | 11.78 | 11.08 | 11.97 |
| Black Charm/Blend | 17.17 | 17.51 | 17.42 | 17.30 |
| Coffee/Blend | 18.90 | 18.72 | 19.00 | 19.10 |
| Blueberry/Cotton | 19.73 | 20.94 | 21.04 | 20.60 |
| Grape Juice/Blend | 40.79 | 41.20 | 41.94 | 41.73 |
| Blood/Cotton | 2.33 | 2.77 | 2.30 | 2.30 |
| Grass/Blend | 7.64 | 7.94 | 8.06 | 8.16 |
| Chocolate/Blend | 19.47 | 19.62 | 20.18 | 19.55 |

Surfactant 24 is Alcohol 17, which is alkoxylated with 5.5 moles (average) of ethylene oxide, as like described above with Examples 25-30.

Surfactant 25 is Alcohol 17, which is alkoxylated with 6 moles (average) of ethylene oxide, as like described above with Examples 25-30.

Surfactant 26 is a mixture of 80 percent (by weight) of Alcohol 17 and 20 percent (by weight) of Alcohol 18, which is alkoxylated with 6.5 moles (average) of ethylene oxide after combining the surfactants, as like described above with Examples 25-30.

An additional Example is prepared (Example 100) to illustrate replacement of NPE with the cleaning composition, e.g. Surfactant 16, of the present invention.

TABLE XIX

| | Example | |
|---|---|---|
| | 40 | 100 |
| Component | | |
| Anionic Surfactant | | |
| Surfactant 19 | 3.00 | 3.00 |

TABLE XIX-continued

| | Example | |
|---|---|---|
| | 40 | 100 |
| Nonionic Surfactant | | |
| Control Surfactant 2 | — | 3.00 |
| Surfactant 16 | 3.00 | — |
| Builder Component | | |
| Builder 1 | 1.00 | 1.00 |
| Bleach Component | | |
| Bleach 1 | 1.00 | 1.00 |
| Water | 92.0 | 92.0 |
| Total | 100 | 100 |
| viscosity (cps, spindle #2 | 98 | 90 |

As illustrated in table above in Table XIX, viscosity of Example 40 is greater than that of Example 100, which illustrates a detergent composition of the present invention excluding NPE. Overall, Example 40 provided an excellent combination of viscosity, detergency and solubility. In other words, Example 40 provided an excellent replacement for a nonionic surfactant such as ethoxylated nonylphenol (NPE), e.g. Control Surfactant 2.

The present invention has been described herein in an illustrative manner, and it is to be understood that the terminology which has been used is intended to be in the nature of words of description rather than of limitation. Obviously, many modifications and variations of the present invention are possible in light of the above teachings. The invention may be practiced otherwise than as specifically described within the scope of the appended claims.

What is claimed is:

1. A cleaning composition comprising:

(A) a first surfactant of the general formula $R^1$—O-$(A)_m$H wherein $R^1$ is an aliphatic hydrocarbon having on average from 12 to 16 carbon atoms, A is an alkyleneoxy group, and subscript m is a positive number; and (B) a second surfactant of the general formula $R^2$—O—$(B)_n$H wherein $R^2$ is an aliphatic hydrocarbon having on average from 12 to 15 carbon atoms, B is an alkyleneoxy group, and subscript n is a positive number;

each of said first and second surfactants having an average degree of alkoxylation of from about 3 to about 7 moles and said cleaning composition having an excess of said first surfactant relative to said second surfactant; and (C) a third surfactant different from said first surfactant and said second surfactant.

2. A cleaning composition as set forth in claim 1 wherein said first surfactant is present in said cleaning composition in a weight ratio of from about 3:1 to about 5:1 relative to said second surfactant.

3. A cleaning composition as set forth in claim 1 wherein said first surfactant is present in said cleaning composition in a weight ratio of about 4:1 relative to said second surfactant.

4. A cleaning composition as set forth in claim 1 wherein $R^1$ of said first surfactant is an aliphatic hydrocarbon having on average from 12 to 14 carbon atoms.

5. A cleaning composition as set forth in claim 4 wherein $R^1$ of said first surfactant is linear.

6. A cleaning composition as set forth in claim 4 wherein $R^2$ of said second surfactant is an aliphatic hydrocarbon having on average from 13 to 15 carbon atoms.

7. A cleaning composition as set forth in claim 1 wherein $R^2$ of said second surfactant is an aliphatic hydrocarbon having on average from 13 to 15 carbon atoms.

8. A cleaning composition as set forth in claim 7 wherein $R^2$ of said second surfactant is branched with an average degree of branching of from about 3 to about 5.

9. A cleaning composition as set forth in claim 1 wherein A of said first surfactant is an ethyleneoxy group.

10. A cleaning composition as set forth in claim 9 wherein B of said second surfactant is an ethyleneoxy group.

11. A cleaning composition as set forth in claim 1 wherein said average degree of alkoxylation of each of said first and second surfactants is from about 5 to about 7 moles.

12. A cleaning composition as set forth in claim 1 wherein said average degree of alkoxylation of each of said first and second surfactants is about 6 moles.

13. A cleaning composition as set forth in claim 1 wherein said third surfactant is a linear alkyl sulfonate (LAS).

14. A cleaning composition as set forth in claim 1 wherein said third surfactant is an alkyl ether sulfate (AES).

15. A cleaning composition as set forth in claim 1 wherein said third surfactant is present in said cleaning composition in a weight ratio of from about 2:1 to about 1:5 relative to said first surfactant and said second surfactant combined.

16. A cleaning composition as set forth in claim 1 wherein said third surfactant is present in said cleaning composition in a weight ratio of from about 1:1 to about 1:3 relative to said first surfactant and said second surfactant combined.

17. A cleaning composition as set forth in claim 1 wherein said third surfactant is present in said cleaning composition in an amount of from about 25 to about 50 parts by weight, said first surfactant is present in said cleaning composition in an amount of from about 40 to about 60 parts by weight, and said second surfactant is present in said cleaning composition in an amount of from about 10 to about 15 parts by weight, all based on 100 parts by weight of said cleaning composition.

18. A cleaning composition as set forth in claim 1 wherein said first surfactant is present in said cleaning composition in an amount of from about 40 to about 90 parts by weight and said second surfactant is present in second cleaning composition in an amount of from about 10 to about 60 parts by weight, both based on 100 parts by weight of said cleaning composition.

19. A method of forming a cleaning composition comprising (A) a first surfactant of the general formula $R^1$—O-$(A)_m$H wherein $R^1$ is an aliphatic hydrocarbon having on average from 12 to 16 carbon atoms, A is an alkyleneoxy group, and subscript m is a positive number, (B) a second surfactant of the general formula $R^2$—O—$(B)_n$H wherein $R^2$ is an aliphatic hydrocarbon having on average from 12 to 15 carbon atoms, B is an alkyleneoxy group, and subscript n is a positive number, each of the first and second surfactants having an average degree of alkoxylation of from about 3 to about 7 moles, and (C) a third surfactant different from said first surfactant and said second surfactant, said method comprising the steps of:

i) alkoxylating a first aliphatic alcohol having on average from 12 to 16 carbon atoms in the presence of a catalyst to form the first surfactant;

ii) alkoxylating a second aliphatic alcohol having on average from 12 to 15 carbon atoms in the presence of a catalyst to form the second surfactant; and iii) combining the third surfactant and an excess of the first surfactant relative to and with the second surfactant to form the cleaning composition.

20. A detergent composition comprising:

(I) a nonionic surfactant present in an amount of from about 1 to about 9 parts by weight based on 100 parts by weight of said detergent composition and comprising (A) a first surfactant of the general formula $R^1$—O-$(A)_m$H wherein $R^1$ is an aliphatic hydrocarbon having on average from 12 to 16 carbon atoms, A is an alkyleneoxy group, and subscript m is a positive number, and (B) a second surfactant of the general formula $R^2$—O—$(B)_n$H wherein $R^2$ is an aliphatic hydrocarbon having on average from 12 to 15 carbon atoms, B is an alkyleneoxy group, and subscript n is a positive number, each of said first and second surfactants having an average degree of alkoxylation of from about 3 to about 7 moles and said nonionic surfactant having an excess of said first surfactant relative to said second surfactant;

(II) an anionic surfactant present in an amount of from about 1 to about 9 parts by weight based on 100 parts by weight of said detergent composition;

(III) an additive; and (IV) water.

21. A detergent composition as set forth in claim 20 wherein said first surfactant is present in said nonionic surfactant in a weight ratio of from about 3:1 to about 5:1 relative to said second surfactant.

22. A detergent composition as set forth in claim 20 wherein said first surfactant is present in said nonionic surfactant in a weight ratio of about 4:1 relative to said second surfactant.

23. A detergent composition as set forth in claim 20 wherein said average degree of alkoxylation of each of said first and second surfactants is from about 5 to about 7 moles.

24. A detergent composition as set forth in claim 20 wherein said degree of alkoxylation of each of said first and second surfactants is about 6 moles.

25. A detergent composition as set forth in claim 20 wherein said nonionic surfactant is present in an amount of from about 1 to about 3 parts by weight, and said anionic surfactant is present in an amount of from about 3 to about 9 parts by weight, each based on 100 parts by weight of said detergent composition.

26. A detergent composition as set forth in claim 20 wherein said anionic surfactant is a linear alkyl sulfonate (LAS).

27. A detergent composition as set forth in claim 20 wherein said anionic surfactant is an alkyl ether sulfate (AES).

28. A detergent composition as set forth in claim 20 having a viscosity of at least about 50 cP at 20° C.

29. A detergent composition as set forth in claim 20 having a viscosity of at least about 75 cP at 20° C.

30. A detergent composition as set forth in claim 20 having a viscosity of at least about 100 cP at 20° C.

31. A detergent composition as set forth in claim 20 wherein said additive comprises at least one of a builder component and a bleach component.

32. A detergent composition as set forth in claim 31 wherein said additive is present in an amount of from about 1 to about 5 parts by weight based on 100 parts by weight of said detergent composition.

33. A detergent composition as set forth in claim 20 wherein $R^1$ of said first surfactant is an aliphatic hydrocarbon having on average from 12 to 14 carbon atoms.

34. A detergent composition as set forth in claim 20 wherein $R^2$ of said second surfactant is an aliphatic hydrocarbon having on average from 13 to 15 carbon atoms.

35. A detergent composition as set forth in claim 20 wherein A of said first surfactant is an ethyleneoxy group.

36. A detergent composition as set forth in claim 20 wherein B of said second surfactant is an ethyleneoxy group.

37. A detergent composition as set forth in claim 20 wherein $R^1$ of said first surfactant is linear.

38. A detergent composition as set forth in claim 20 wherein $R^2$ of said second surfactant is branched with an average degree of branching of from about 3 to about 5.

* * * * *